US005666598A

United States Patent [19]

Sugita et al.

[11] Patent Number: 5,666,598

[45] Date of Patent: Sep. 9, 1997

[54] IMAGE FORMING METHOD AND APPARATUS USING ENERGY BEAM IMPINGEMENT ON IMAGE FORMING PARTICLES TO MOVE THE SAME

[75] Inventors: Tatsuya Sugita, Hitachi; Akira Arimoto, Kodaira; Teruaki Mitsuya, Naka-machi; Nobuyoshi Hoshi, Hitachinaka; Mamoru Okano; Atsushi Onose, both of Hitachi; Yoshito Tsunoda, Tokyo; Shinya Kobayashi, Mito; Seiji Maruo; Yasuo Takuma, both of Hitachi, all of Japan

[73] Assignee: Hitachi, Ltd., Tokyo, Japan

[21] Appl. No.: 405,891

[22] Filed: Mar. 17, 1995

[30] Foreign Application Priority Data

Mar. 18, 1994 [JP] Japan ..... 6-048236
Apr. 20, 1994 [JP] Japan ..... 6-081271

[51] Int. Cl.[6] ..... G03G 15/14

[52] U.S. Cl. ..... 399/136; 347/199; 347/224; 399/297

[58] Field of Search ..... 355/271, 274, 355/326 R, 210, 200, 279; 347/239, 232, 199, 224; 346/140.1; 399/136, 297

[56] References Cited

U.S. PATENT DOCUMENTS 4,470,055 9/1984 Todoh ..... 346/140.1
4,801,950 1/1989 Frehling ..... 347/239

FOREIGN PATENT DOCUMENTS 59-102269 6/1984 Japan .
60-64364 4/1985 Japan ..... 355/271
4-010955 1/1992 Japan .

*Primary Examiner*—Shuk Yin Lee
*Attorney, Agent, or Firm*—Antonelli, Terry, Stout & Kraus, LLP

[57] ABSTRACT

A high-speed image forming method and apparatus is capable of directly controlling a toner by the force of an energy beam. Selected toner particles in a mass of toner adhering to the surface of a transparent drum are irradiated with a laser beam emitted by a laser disposed within the transparent drum and controlled for scanning according to image information. The laser beam separates the selected toner particles from the transparent drum by the force it produces on the particles, and then the separated toner particles are moved to a paper sheet by the force of an electric field produced by a developing electrode. Each toner particle need only be irradiated with the light for a comparatively short period of time, so that an image can be formed at high speed.

32 Claims, 15 Drawing Sheets

IMAGE FORMING METHOD AND APPARATUS USING ENERGY BEAM IMPINGEMENT ON IMAGE FORMING PARTICLES TO MOVE THE SAME

BACKGROUND OF THE INVENTION

The present invention relates to an image forming method and an image forming apparatus, such as a printer, facsimile, or copying machine or the like.

A known form of a photocopier produces a printed image on a piece of paper by forming an electrical image on a photoconductive member, applying toner to the electrical image, and transferring the toner to a paper sheet to form an image thereon, which is then fixed. Such a photocopier-must be provided with a photoconductive member, a charger, an exposure device, a developing device, a transfer device, a static eliminator, a cleaning device, a fixing device and the like. Thus, it is difficult to produce a photocopier that is compact and relatively cheap.

Furthermore, such a photocopier forms a toner image on the paper and then fixes the toner image using a fixing device. Therefore, if an unnecessary portion of the toner adheres to the paper in processes preceding the fixing process, the unnecessary portion of the toner is fixed together with the toner image, causing a blooming that deteriorates the picture quality.

An image forming apparatus disclosed in Japanese Patent Application JP-A-4-10955 controls the movement of particles of a toner with a light beam. The toner is constrained to move within a toner chamber and the light beam is directed at particles of the toner in order to move those particles onto a piece of paper. The toner on the paper is then subsequently fixed.

In this system, control of the motion of the toner particles is achieved by giving kinetic energy to the particles with a concentrated laser beam as they are floating in the air in the toner chamber. However, the movement of toner is very small because the duration of irradiation of the toner with the scanning light beam is comparatively short and the force produced by the light beam is comparatively low.

Since the motion of toner particles in the air must be controlled, and the motion of the particles is subject to the resistance of the air, any moving toner particles are brought to a stop in a relatively short time. In other words, it is difficult for the light beam to move the toner particles very far. Therefore when this image forming apparatus performs a scanning operation at a practical image forming speed, the distance of movement of the toner is in the order of 1 μm. Therefore, each particle of the toner would have to be irradiated with light for a comparatively long period of time in order for the energy supplied to be sufficient to move each particle of the toner a sufficiently long distance to the paper. Hence, the image forming apparatus cannot complete an image in a practical amount of time.

Furthermore, if the particles of toner are irradiated with light for a comparatively long period of time, the motion of the irradiated particles of the toner are disturbed by the normal Brownian motions of the other toner particles, together with the variation of ambient conditions and, consequently, the formation of a clear image is prevented.

A further problem is that, since the distance of movement of the toner caused by the light is comparatively short, the size of the toner chamber must be relatively small when the toner is supplied in a floating state. However, it is difficult to supply the toner in a floating state through a thin space, as the toner circulating path in the chamber becomes clogged with the toner. It is therefore difficult to supply the image forming medium stably and consistently.

Furthermore, as the toner particles float within a circulating passage having an opening through which the toner particles are delivered to the paper, toner particles may "fall" through the opening onto the paper without being contacted by the light beam. This causes blooming.

An image forming apparatus disclosed in Japanese Patent Application JP-A-59-102269 irradiates a toner adhering to a toner conveying member with a laser beam in a developing and transferring unit in order to melt the toner, and to transfer and fix the toner to a recording sheet.

A paper entitled "Characteristics of Thermal Transfer Printing by Laser Heating (iii)—Study of Colour Printing Process" by Mitsuru Irie et al, from (pages 8–13), discusses thermal transfer colour printing using laser heating. In this process a coloured ink ribbon is placed against a piece of paper and ink is transferred from the ribbon to the paper using a laser beam.

In a paper entitled "Tonerjet—a Direct Printing Process" by Jerome Johnson et al, from (pages 509–512), a direct printing process is disclosed. In this process, charged toner particles are deposited directly onto a paper surface to form a visible image pattern. An array of wire mesh electrodes is used to create individual dot-sized electrostatic fields and charged toner particles are drawn through the wire mesh openings from a toner container and are deposited onto a plain paper surface in the desired visible image pattern. Once on the paper the toner particles are fused to form a permanent image.

SUMMARY OF THE INVENTION

It is an object of the present invention to provide an image forming method and apparatus that controls the movement of an image forming medium by a force produced by an energy beam modulated according to image information, and which is preferably capable of stably supplying the image forming medium to an irradiating zone and mitigating some or all of the above problems.

Accordingly, in a first aspect the present invention provides an apparatus for production of an image on a recording medium, the apparatus including a mass of toner and means for production of an energy beam, the energy beam being modulatable by image information and directable at selected particles of the mass of toner in order to impart energy to the selected particles. The apparatus also includes an energy source, other than the means for production of an energy beam, for imparting additional energy to the selected particles to move the selected particles onto the recording medium.

Thus, the energy beam does not need to provide all the energy necessary to transfer the selected particles to the recording medium and therefore the problem of needing to irradiate the particles for a relatively long period of time is avoided.

The term "toner" as used with respect to the present invention includes all image forming media which are suitable for forming an image on a recording medium, such as ink on paper.

Preferably, the means for production of an energy beam includes light means for production of one or more light beams. Preferably the energy density of the light received by the toner is 0.53 J/cm$^2$ or above.

Preferably, in this and/or the other aspects of the present invention, the energy beam is applied directly to the selected particles—in other words, there is direct irradiation of the particles.

Preferably, the energy source includes means for production of an electric field to move the selected particles onto the recording medium. Additionally or alternatively, the energy source may include other means for providing kinetic energy to the particles, such as by vibrating the particles.

The apparatus may include a hollow member, such as a drum or a continuous belt, the member having a surface against which at least part of the mass of toner, including the selected particles, is retainable, wherein the means for production of an energy beam is located inside the hollow member.

Preferably, the hollow member includes a first electrode which is part of the means for producing an electric field.

In one embodiment, the apparatus includes a second electrode which is part of the means for producing an electric field, the second electrode being positioned so as to be on the opposite side of the recording medium to the first electrode when the selected particles are being moved onto the recording medium.

In a second embodiment, the apparatus includes a second electrode which is part of the means for producing an electric field, the second electrode being positioned so as to be between the recording medium and the first electrode when the selected particles are being moved onto the recording medium, the second electrode having an aperture through which the selected particles are movable.

Preferably, the light means includes means for production of an array of light beams. Preferably, a plurality of light beams are producable by the light means, each one of the plurality of light beams carrying data relating to production of a differently coloured image on the recording medium.

Preferably, the apparatus includes means for fixing the selected particles to the recording medium, and means for removing unfixed toner from the recording medium. Said means for fixing may include the light means i.e. the image forming apparatus forms an image with light and melts the image forming medium (toner) by the energy of the same light. Alternatively, the present invention may employ a sound wave, a microwave or a heater instead of light to form an image with a powdered image forming medium and may fix the image forming medium by the energy of the sound wave, the microwave or the heater for the same effect.

According to a second aspect, the present invention provides a method of producing an image on a recording medium, including the steps of: (i) selecting particles of a mass of toner by imparting energy thereto by irradiation by an energy beam modulated by image information, followed by (ii) moving the selected particles onto the recording medium at least partially using additional energy from an energy source other than the energy beam.

Preferably, the selected particles carry an electrostatic charge and the additional energy is imparted to the selected particles by an electric field. The selected particles may be separated from the mass of toner by step (i), and the particles may be fixed onto the recording medium by direct irradiation by the energy beam.

The method may further include the step of subsequently removing from the recording medium any unfixed particles of the mass of toner carried thereon.

According to a further aspect, the present invention provides a method of producing an image on a recording medium, including the steps of: (i) fixing selected particles of a mass of toner onto the recording medium by direct irradiation by an energy beam modulated by image information, followed by (ii) removing from the recording medium any unfixed particles of the mass of toner carried thereon.

Preferably, the mass of toner is applied to the recording medium prior to step (i).

According to a further aspect, the present invention provides an apparatus for producing an image on a recording medium, the apparatus including a mass of toner, means for production of an energy beam, the beam being modulatable by image information and directable at selected particles of the mass of toner in order to fix the selected particles to the recording medium, and means for removing from the recording medium any unfixed particles carried thereon.

The image forming medium (i.e. toner) may be a powder, and selected particles (i.e. the image forming portion of the image forming medium) and the rest of the mass of toner (the unnecessary portion of the image forming medium adhering to the recording medium) may be discriminated from each other when the selected particles are fixed (e.g. by melting) to the recording medium by the means for production of an energy beam. Accordingly, the unnecessary portion of the image forming medium can be removed by the removing means to prevent blooming after forming the image.

Thus, the present invention is capable of completing by a single process, the exposure process, the developing process, the transfer process and the fixing process of an electrophotographic process so that the image forming apparatus can be formed in a simple, small construction. Additionally the present invention provides an image forming apparatus capable of forming an image with a toner and of preventing the deterioration of picture quality attributable to blooming.

The apparatus may include means for applying the mass of toner to the recording medium, which may include an electrostatic carrier to which at least a part of the mass of toner is attachable prior to application to the recording medium.

According to a further aspect, the present invention provides a method of producing an image on a recording medium, including the steps of: (i) confining a mass of toner in a space, at least a part of the boundary of the space being formed by a first energy beam, and (ii) selectively removing particles of the mass of toner from the space and depositing the particles onto the recording medium.

Preferably, the first energy beam is substantially planar and a further part of the boundary of the space is defined by a second substantially planar energy beam which is substantially parallel to the first energy beam.

Preferably, in step (ii) the particles are removed by direct irradiation by a third energy beam, the third energy beam being modulated by image information.

According to yet a further aspect, the present invention provides a method of producing an image on a recording medium, including the steps of: (i) selecting particles of a mass of toner by imparting energy thereto by irradiation by a first energy beam modulated by image information, followed by (ii) moving the selected particles onto the recording medium, and (iii) fixing the selected particles onto the recording medium by direct irradiation by a second energy beam modulated by image information.

Preferably both the first energy beam and the second energy beam are produced by one energy beam production means.

According to yet a further aspect, the present invention provides a method of producing an image on a recording medium, including the steps of: (i) electrostatically carrying a mass of toner to a predetermined location, (ii) at the location, selecting particles of the mass of toner by imparting energy thereto by irradiation by an energy beam modulated by image information, followed by (iii) moving the selected particles onto the recording medium.

According to yet a further aspect, the present invention provides apparatus for producing an image on a recording medium, the apparatus including: a substantially transparent drum, a mass of toner carried on the drum, and means for production of an energy beam, the energy beam being modulatable by image information and directable at selected particles of the mass of toner in order to impart energy to the selected particles, the means for production of an energy beam being located inside the substantially transparent drum.

Preferably, included are means for production of an electric field to move the selected particles onto the recording medium, the drum including an electrode which is part of the means for production of an electric field.

BRIEF DESCRIPTION OF THE DRAWINGS

Embodiments of the invention will now be described by way of non-limitative examples with reference to the accompanying drawings. In the drawings:

FIG. 7(*b*) is a schematic view of part of the image forming apparatus of FIG. 7(*a*).

DETAILED DESCRIPTION OF THE PREFERRED EMBODIMENTS

Figure 1A:
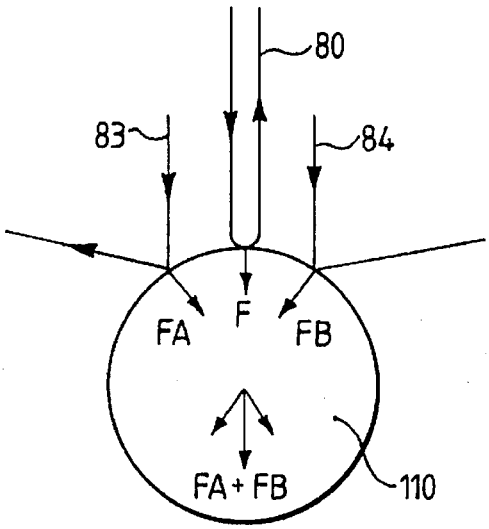
FIGS. 1(*a*) and 1(*b*) are diagrammatic views showing the effect of light pressure on a particle of toner.
Figure 1B:
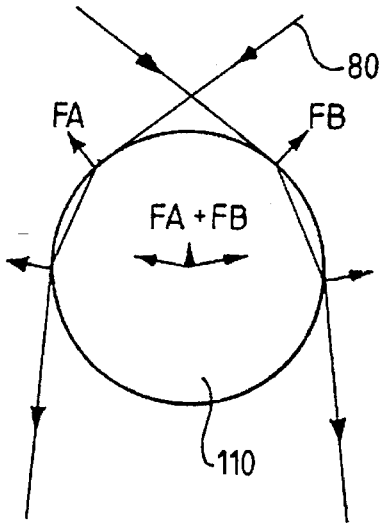

First the force produced on a toner particle by light will be described. Light has a momentum. Referring to FIGS. 1(*a*) and 1(*b*), when a light beam 80 falls on a medium, such as particle 110, the light is reflected and the travelling direction of the light is changed by refraction. Consequently, the momentum of the light changes and exerts a pressure F to the medium that changed the travelling direction of the light. The pressure F acting on the medium that changed the travelling direction of the light reaches a maximum when the total incident light is reflected in a direction opposite the incoming direction of the incident light.

The light pressure F is expressed by:

$$F=2P/c$$

where P is the power of the light, and c is the speed of light.

When light falls on a particle, the light pressure decreases according to a scattering condition dependent on the optical characteristics of the particle, such as shape, refractive index, absorption factor and such, and actual pressure F that acts on the particle is:

$$F=(2P/c)q\ 0\leqq q\leqq 1$$

where q is the scattering coefficient for correction.

Thus light such as beams 83, 84, falling on the particle 110, such that the reflected angle is less than 180°, produce forces FA and FB, respectively, which forces are less than F.

As shown in FIG. 1(*b*), since a transparent particle receives a force in a direction in which the light intensity is high, owing to the refraction of light by the particle, the particle can be trapped by the concentrated light. Therefore, the image forming medium 110 trapped by the light can be moved to a predetermined position.

When forming an image by scanning with a light beam, the light beam must be moved at a high scanning speed. Therefore, each particle is irradiated with the light beam for a very short time and hence the particle is moved a very short distance by the light pressure.

However, if the light pressure is used for destroying the balance of forces acting on the image forming medium 110 rather than for supplying kinetic energy to the image forming medium 110 to enable it to reach an image recording medium, an image can be formed quickly even if the image is formed by scanning with a light beam.

When the force restraining the image forming medium 110 is higher than the light pressure, the force may be countered by applying an additional force such as an electrostatic force, a magnetic force, a centrifugal force or the like to the particle and the particle is thereby freed from restraint by the light pressure. After the particle has been freed from restraint, the particle can be moved by a force other than the light pressure.

In such a case, since the particle needs to be irradiated with a light to apply only the pressure necessary to free the particle, the particle may be irradiated with the light beam for a comparatively short time and hence the light beam may be moved for high-speed scanning.

Since the image forming medium is restrained, it can be stably supplied to an irradiating zone where it can be irradiated by the light beam. The image forming medium may be restrained by adhesion, light pressure, sound pressure or the like.

Figure 2:
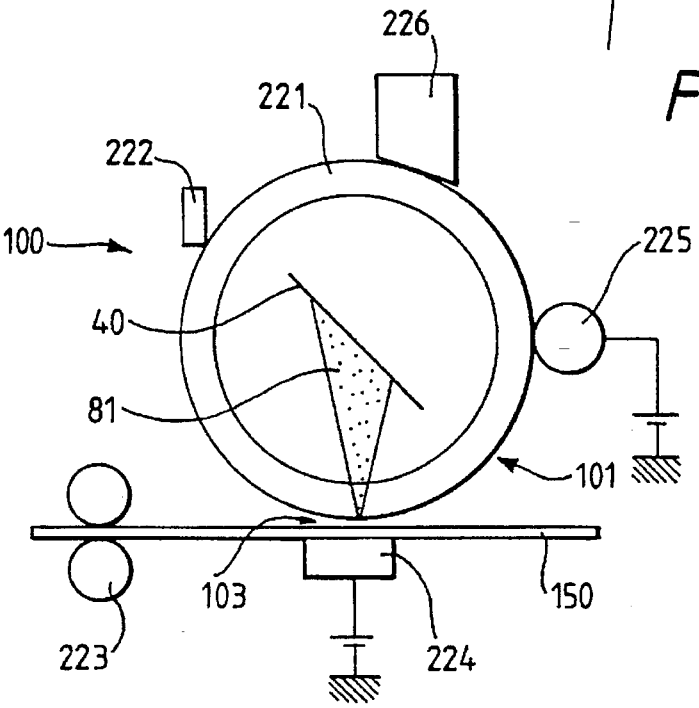
FIG. 2 is a schematic side view of a first embodiment of an image forming apparatus according to the present invention.

FIG. 2 shows an image forming apparatus 100, in which an image forming medium 101 adhering to a drum 221 is transported to a position 103 under a light beam 81.

The image forming medium 101 i.e. toner is charged and is applied to the circumference of the transparent drum 221 by a toner applying unit 226 so that the toner adheres to the circumference of the drum 221 in a uniform thickness. The drum is charged with an image charge so that the charged toner is attracted to the drum 221. Then, an unnecessary portion of the toner 101 is removed by an electric field created by a toner selecting unit 225.

When exposed to a concentrated laser beam 81, the toner is separated from the transparent drum 221 by light pressure, and then the toner is attracted to a paper sheet 150, (i.e., an image recording medium) by an additional energy source, such as an electric field created by a developing electrode 224.

The laser beam 81 is concentrated by a lens, not shown, and the laser beam is moved for scanning by an optical scanning unit 40. The intensity of the laser beam 81 is modulated according to image information representing an image to be formed on the paper sheet 150 so that desired portions of the surface of the paper sheet are irradiated. The laser beam 81 may be emitted by means for production of an energy beam, such as a semiconductor laser.

The toner transferred to the paper sheet 150 advances together with the paper sheet 150 to a fixing unit 223, and then the fixing unit 223 fixes the toner to the paper sheet 150. The toner remaining on the drum 221 is removed by a cleaning unit 222.

Figure 3:
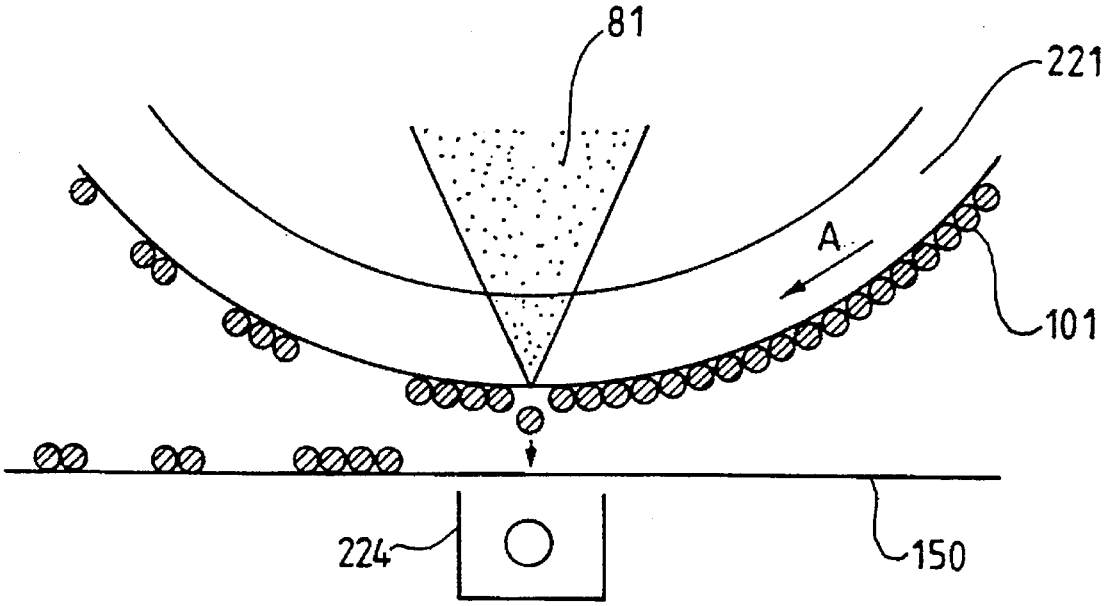
FIG. 3 is an enlarged schematic view of a portion of the image forming apparatus of FIG. 2.

FIG. 3 is an enlarged view of an irradiating zone 103. Charged toner particles 101 adhering to the surface of the transparent drum 221 are carried to the irradiating zone as the transparent drum 221 rotates in the direction given by arrow A. The toner separated by a pressure produced by the laser beam 81 is subject to only the electrostatic force of the electric field created by the developing electrode 224, so that the toner particles 101 are attracted to the paper sheet 150.

Figure 4:
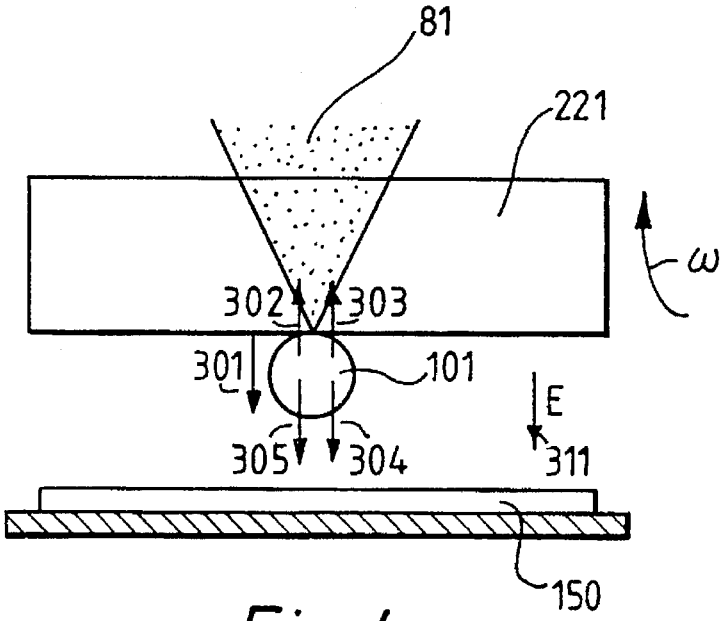
FIG. 4 is a diagrammatic view showing the forces acting on toner particles in the apparatus of FIG. 2.

FIG. 4 shows forces acting on the toner 101 when it is irradiated with the laser beam 81 of the image forming apparatus of FIG. 3. In this embodiment, the toner is attracted to the transparent drum 221 by an electrostatic force 303 produced by an image charge induced in the drum by the charge of the toner, and an adhesion force 302, such as a van der Waals force, between the drum and the toner.

An electrostatic force 304 produced by an electric field 311 created by the developing electrode 224, a centrifugal force 305 acting on the toner as the drum rotates and a light pressure 301 all bias the toner away from the drum.

When the forces attracting the toner to the drum and the forces acting on the toner to separate the toner from the drum (excluding the light pressure 301) are substantially balanced and the toner is attracted to the drum by a comparatively low force, the toner particles 101 may be separated from the drum by the light pressure 301.

Figure 5:
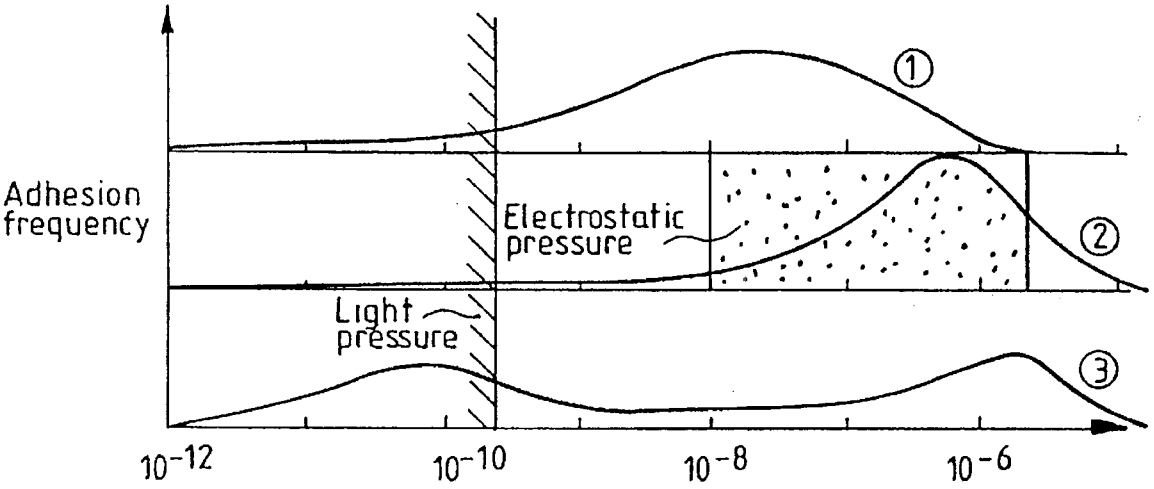
FIG. 5 is a graph of strength/frequency showing the distribution of the adhesion of a toner during operation of the apparatus of FIG. 2.

However, there will be a variation in the amount of force holding any particular toner particle to the drum, as shown in FIG. 5. Thus, toner particles attracted to the drum by a comparatively low force may become unintentionally separated from the drum by the electrostatic force produced by the electric field 311, thereby causing blooming. To avoid this, such toner particles attracted by a comparatively low force are removed from the drum in advance of the irradiation zone 103 by an electrostatic force of an electric field created by a toner selecting electrode 225 and preferably having an intensity equal to that of the electric field 311.

FIG. 5 shows the distribution of adhesion strength against an amount of toner having that strength. When the adhesion is reduced by the electric field (graph 3), a sufficiently large quantity of the toner is held with an adhesion strength of only around $10^{-10}$N and may be separated from the drum by the light pressure. Since this embodiment uses the light pressure to separate the toner from the drum, the duration of irradiation of the toner with the light beam may be comparatively short, and hence an image can be formed even if the laser beam is moved for scanning at a high scanning speed.

In this embodiment, the image recording medium is a paper sheet, a plastic film or the like.

A dye, a colorant, or a toner produced by dispersing a dye or a colorant in a plastic base or a liquid colour, such as an ink, may be used as the image forming medium.

Although only light pressure is mentioned above as being the force produced by the light beam and acting on the image forming medium, the light beam also produces a photophoretic force and a force due to the thermal expansion of the image forming medium. This embodiment of the present invention is characterized by the use of a force produced by light energy to move the image forming medium. Any one of the aforesaid forces may be used for the same effect.

The action of photophoretic forces will now be described. Since the toner is highly light-absorptive, the toner absorbs light and heat from the light energy, and the light-receiving side of the toner is heated particularly intensively. As the temperature of the toner rises, the ambient air is heated by the toner. Since temperature distribution in the toner is localized, air on the side of the higher-temperature-side of the toner is heated to a higher temperature and the energy of molecules of the air impinging on the higher-temperature-side of the toner increases.

Consequently, the toner particles are caused to migrate by a photophoretic force from the higher-temperature-side of the mass of toner toward the lower-temperature-side. Since the toner is highly light-absorptive and the incident light beam is absorbed at a high rate in the light-receiving side of the toner, the toner particles are caused to migrate in the direction of travel of the light beam by a photophoretic force; that is, the photophoretic force acts effectively on the toner particles to move the toner particles in the same direction as the light pressure and, consequently, the toner particles are moved by a distance longer than that by which they would be moved if only acted on by the light pressure. It is desirable that the light beam is absorbed at a high rate by the surface of the toner. Therefrom, desirably, the toner may contain a colorant, such as carbon black or a dye, in a high density in the surface.

Scattering and absorption of light by fine particles can be determined by using an expression expressing Mie scittering. Mie scattering is dependent on the respective complex indices of refraction of the ambience and the fine particles, the shape of the fine particles and the wavelength of the light beam. When the respective size parameters x of fine particles are the same, scattering conditions of the light beam in the fine particles are the same. x may be expressed by:

$$x=2\pi d/\lambda$$

where d is the diameter of spherical fine particles and $\lambda$ is the wavelength of the light beam.

Light pressure is dependent on the scattering condition and when ($x \geqq 4$) light pressure is proportional to the sectional area of the particles. Therefore, it is desirable that the diameter of the particles is not smaller than the wavelength of the light beam. The diameter of the particles need not be greater than the diameter of the concentrated light beam; preferably, the average particle diameter is 50 μm or below, and more preferably, in the range of 5 to 15 μm.

In most toners, the shapes of the toner particles are irregular and there are many definitions of particle size. The present invention uses the diameter of a sphere having the same weight as the toner particles as the particle size of the toner.

It is desirable that the charge of the toner is comparatively small, to reduce the force of the image charge induced in the drum by the charge of the toner and to reduce the force of the image charge and adhesion. It is also desirable that the range of distribution of the charges of the toner particles is comparatively narrow, to reduce the force of the image charge and the adhesion with an electric field. It is also desirable that the ranges of distribution of the charges and the particle sizes of the toner particles are comparatively narrow to uniformize those forces.

In the present invention, the range of distribution of the diameters of toner particles may be 5% or below of the average particle size, and, desirably, 1% or below. Toner particles having shapes approximately resembling true spheres are desirable to form a homogeneous toner.

This embodiment uses a styrene-acrylonitrile toner having a mean particle size of 10 â╧m as the image forming medium. The styrene-acrylonitrile toner absorbs light and can be melted by the heat generated by the absorbed light. A polymeric toner is excellent in the uniformity of shape and hence uniform light pressure acts on the particles. When the toner is uniform in physical properties, the toner selecting unit 225 may be omitted.

When a magnetic toner is used, the balance of forces may be established by using a magnetic force. When the light source has a large power and both development and fixing are possible with the light beam emitted by the light source, the fixing unit may be omitted.

Since the greater the light energy received by the toner particles, the greater is the recoil force applied to the toner particles by the light, it is desirable to use a light beam having a large light energy. If the toner particles are heated to an excessively high temperature by the light absorbed by the toner particles, evapotranspiration and combustion of the toner occurs. Therefore, energy that heats the toner to its ignition temperature is an upper limit energy. The ignition temperatures of plastic materials generally used as the bases of ordinary toners are in the range of 400° to 500° C. When the particle size of the toner is 10 μm, the energy to be applied to each toner particle must be 13 μJ or less. The light pressure must be higher than the gravitational force to control toner particles with the light pressure and, when the particle size of the toner is 10 μm, the power of the light beam must be 0.1 mW or above for each toner particle.

The laser light source may be a gas laser, such as a He-Ne laser, or a solid-state laser, such as a YAG laser. The light beam may be deflected for scanning with a polygonal rotating mirror or an acoustooptic device.

Figure 6:
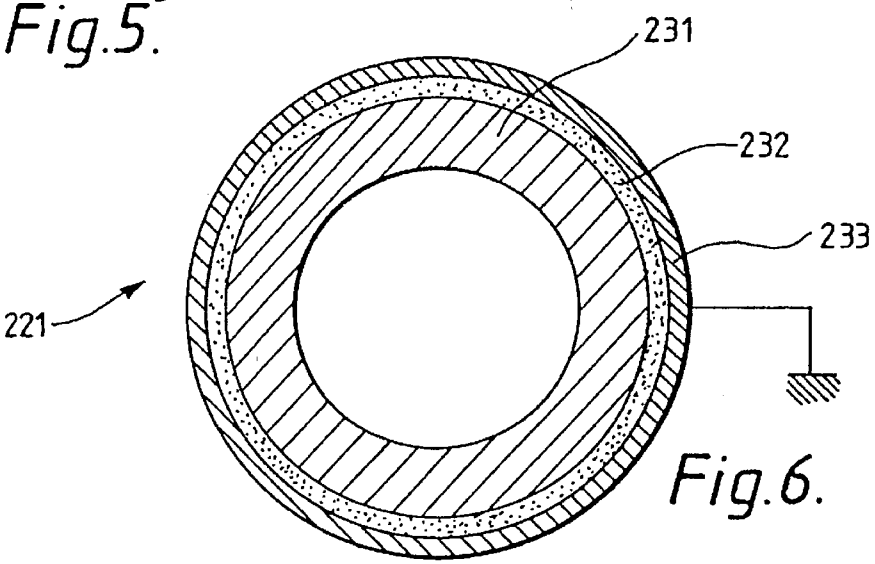
FIG. 6 is a schematic sectional view of a transparent drum of the apparatus of FIG. 2.

FIG. 6 shows an electrode on the transparent drum 221, suitable for the present invention. The transparent drum may be provided with an electrode to create an electric field between the transparent drum and the developing electrode. An electrode 232 is formed over the circumference of the drum body 231 of the transparent drum, and the electrode 232 is coated with a protective film 233. The electrode 232 and the protective film 233 must be transparent. The electrode 232 is an ITO film, and the protective film 233 is a film of a dielectric, such as $SiO_2$, SiN, Al2O3, or AlN.

It is preferable to form the protective film 233 of a material that produces a comparatively low adhesion between the protective film 233 and the toner particles 101. The electrode 232 may be a metal thin film capable of transmitting light. A voltage high enough to create an electric field capable of attracting the charged toner to the paper sheet 150 is applied across the electrode 232 and the developing electrode 224. It is desirable that the clearance between the circumference of the transparent drum 221 and the paper sheet 150 is very small, provided that the toner particles 101 do not touch the paper sheet 150. Preferably, the clearance is 500 μm or less, and more preferably in the range of 50 to 300 μm. When the adhesion between the electrode 232 and the toner is small, the protective film 233 may be omitted.

The drum may be a cylindrical glass drum or a transparent, cylindrical plastic drum. The laser beam is emitted from within the drum. A transparent belt may be employed instead of the drum.

Figure 7A:
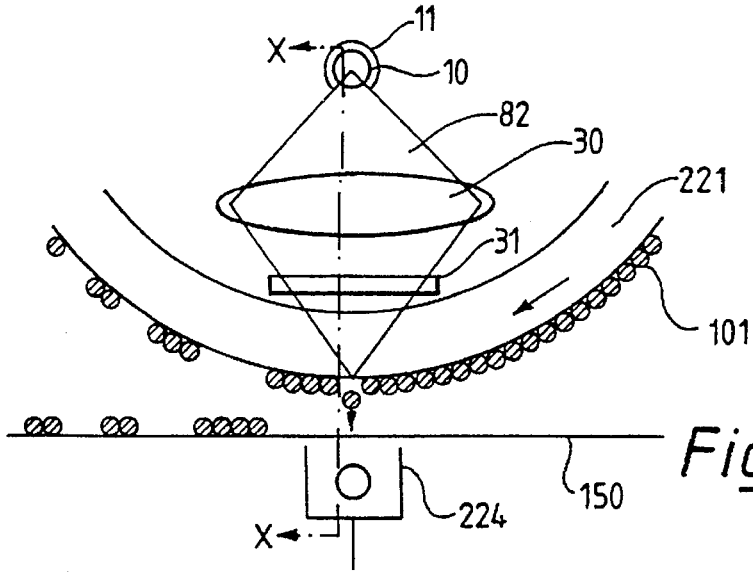
FIG. 7(*a*) is a schematic view of an image forming apparatus according to a second embodiment of the present invention.
Figure 7B:
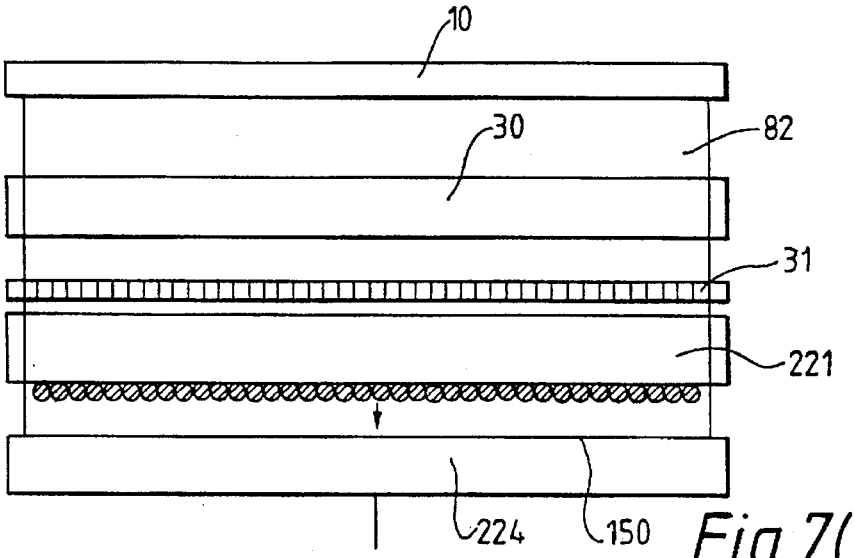

FIGS. 7(*a*) and 7(*b*) show an image forming apparatus according to a second embodiment of the present invention. The image forming apparatus is the same in construction, excluding its optical system, as the image forming apparatus of FIG. 2. The optical system and a portion facing a paper sheet of the image forming apparatus in the second embodiment are shown in enlarged views in FIGS. 7(*a*) and 7(*b*). FIG. 7(*b*) is a sectional view taken along the line x—x in FIG. 7(*a*).

Referring to FIGS. 7(*a*) and 7(*b*), light 82 emitted by a flash lamp 10, i.e., a light source, is concentrated by a cylindrical lens 30, and the concentrated light falls on a spatial modulator 31 comprising a liquid crystal panel. The light transmitted through the spatial modulator 31 falls on toner particles 101 adhering to a transparent drum 221. The toner particles 101 irradiated with the light are caused to travel toward a paper sheet 150 by a force produced by the light, and the moved toner particles 101 are attracted to the paper sheet 150 by an electric field created by a developing electrode 224.

The toner particles 101 are melted by light energy absorbed by the particles. The melted toner particles 101 having kinetic energy adhere to and are fixed to the paper sheet 150 in a fixed toner 102 to form an image. Since developing and fixing are achieved simultaneously, the image forming apparatus in the second embodiment does not need any fixing unit.

The flash lamp 10 preferably has an output light energy of 100 J and an emission period of about 1 msec. A reflector 11 is disposed on one side of the flash light 10, opposite the side on which the lens is disposed with respect to the flash lamp 10, to reflect the light emitted by the flash lamp 10 efficiently toward the lens.

A pulsed laser may be used instead of the flash lamp. A lamp or a laser that emits light constantly may be used when the light emitting capacity of the lamp or the laser is sufficiently large.

The spatial modulator may be disposed between the light source and the lens instead of between the lens and the image recording medium.

Figure 8:
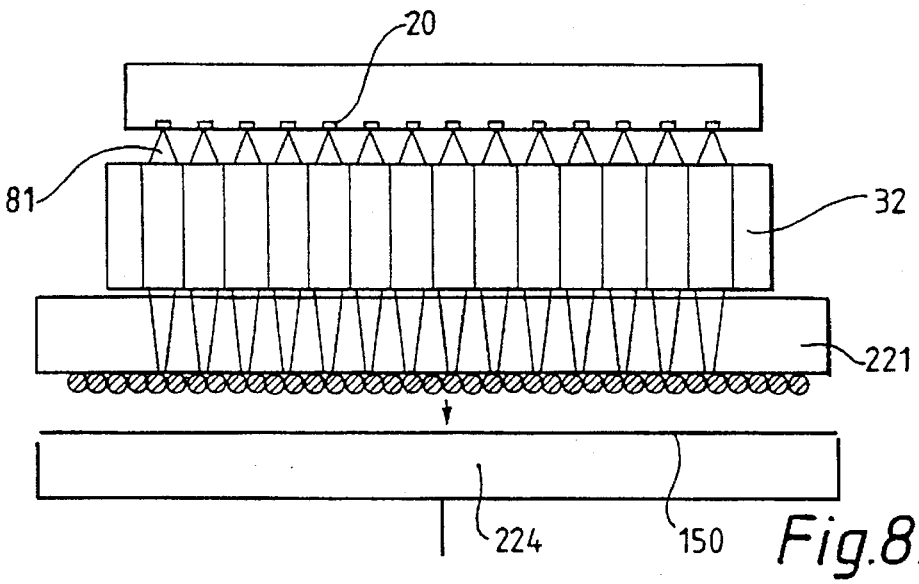
FIG. 8 is a schematic view of a portion of an image forming apparatus according to a third embodiment of the present invention.

FIG. 8 shows a further embodiment of an image forming apparatus according to the present invention. This image forming apparatus is the same in construction, with the exception of its optical system, as the image forming apparatus of FIG. 2. Only the new optical system is shown in FIG. 8, which is a sectional view similar to FIG. 7(*b*).

This embodiment employs a laser diode (LD) array (LD array) 20.

The LD array 20 is a one-dimensional or two-dimensional arrangement of LDs. Since each LD can be controlled for on-off operation, the image forming apparatus need not be provided with any spatial modulator. A rod lens array 32 is disposed so that its component rod lenses correspond to the LDs, respectively, to focus laser beams 81 emitted by the LDs efficiently on the image recording medium. A LED array may be used instead of the LD array.

Figure 9:
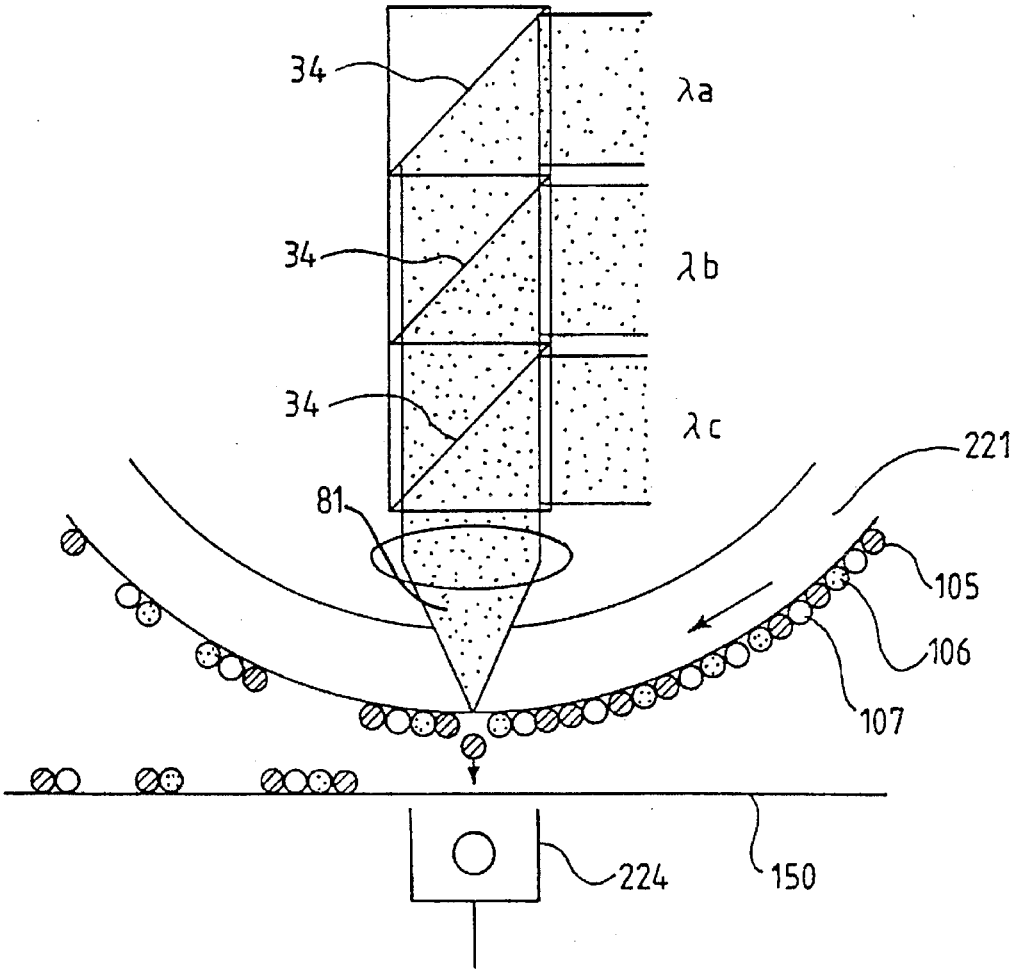
FIG. 9 is a schematic view of a portion of a colour image forming apparatus which is a modification of the image forming apparatus of FIG. 2.

FIG. 9 shows a color image forming apparatus which is a modification of the image forming apparatus of FIG. 2. The color image forming apparatus uses a plurality of color toners (105, 106, 107) to form a color image and is provided with a plurality of light sources (a, b, and c) that emit light beams of different wavelengths ($\lambda a$, $\lambda b$, $\lambda c$) corresponding to the plurality of color toners, respectively.

The color image forming apparatus in this embodiment uses three different kinds of toners respectively having different optical characteristics, and is provided with three lasers that each emit a laser beam, the three beams having different wavelengths. The laser beams emitted by the three lasers are deflected by three dichroic mirrors 34 so as to travel along a single optical path. An optical system disposed on the optical path is the same as that of the image forming apparatus of FIG. 2.

A mixed toner prepared by mixing the three kinds of toners is applied to the circumference of a transparent drum 221. The three kinds of toners receive light pressures only from the light beams emitted by the corresponding lasers, respectively; that is, toner (a) 105 receives a light pressure from the light beam having a wavelength $\lambda a$, the toner (b) 106 receives a light pressure from the light beam having a wavelength $\lambda b$, and the toner (c) 107 receives a light pressure from the light beam having a wavelength $\lambda c$.

The respective intensities of the light beams are controlled to form a color image on a paper sheet 150.

Figure 10:
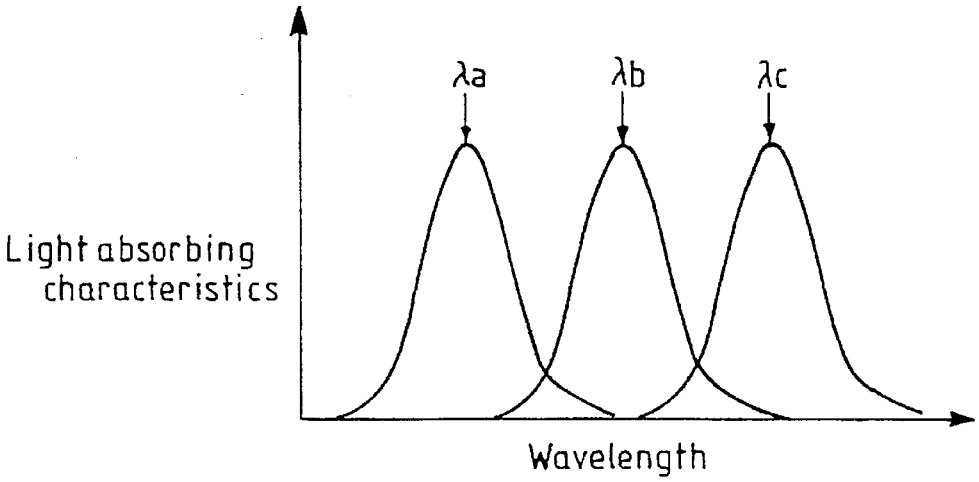
FIG. 10 is a graph showing the light absorbing characteristics of toners used in a colour image forming apparatus of FIG. 9.

A principle of a specific toner receiving a light pressure from a light beam having a specific wavelength is illustrated in FIG. 10. Toners a, b and c have large absorption coefficients to light beams having specific wavelengths, respectively, and have small absorption coefficients to light beams having wavelengths other than those specific wavelengths, respectively. Laser beams having wavelengths respectively corresponding to the peak absorption coefficients of the toners are used to apply light pressures to the corresponding toners so that a color image can be formed.

Thus, according to an aspect of the present invention, a color image forming apparatus can be constructed by providing an image forming apparatus with a plurality of light sources each being for a respective toner, without changing the optical path and the toner applying unit. Therefore, the color image forming apparatus and the black and white image forming apparatus in accordance with the present invention are preferably substantially the same in size and construction. The color image forming apparatus may be provided with additional optical paths and additional toner applying units so as to meet the optical characteristics of the toners.

Color image forming apparatuses can be constructed by providing the image forming apparatuses of FIGS. 7(*a*), 7(*b*) and 8 with a plurality of light sources respectively having different wavelengths or with a spatial modulator capable of displaying a color image.

Figure 11:
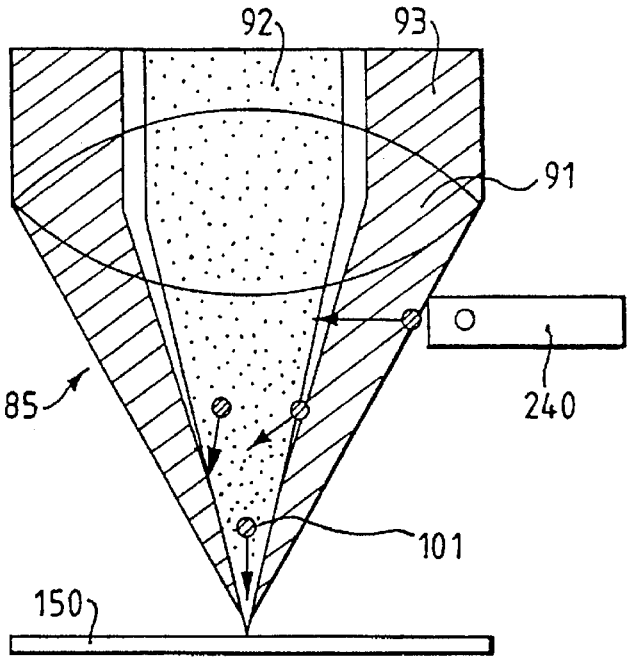
FIG. 11 is a schematic view of a portion of an image forming apparatus according to a further embodiment of the present invention, using a tapering confinement light beam.

FIG. 11 shows a further embodiment of an image forming apparatus according to the present invention. This image forming apparatus confines a toner 101 within a light beam 85. The light beam 81 consists of an assist light beam 92 and a confinement light beam 93 concentric with the assist light beam 92 and having power higher than that of the assist light beam 92, which are projected on to a lens 91.

Toner particles 101 are injected into the assist light beam 92 with a toner injecting mechanism 240. Since the power of the confinement light beam 93 is higher than that of the assist light beam 92, the toner particles 101 that travel from the assist light beam 92 into the confinement light beam 93 are returned into the assist light beam 92 by a repulsive force, so that the toner particles 101 can be confined within the confinement light beam 93.

A force acts on the toner particles 101 within the assist light beam 92 in the direction of travel of the light beams from the lens 91 toward a paper sheet 150 to collect the toner particles 101 in the vicinity of the focal point f the lens 91. The paper sheet 150 is disposed close to the focal point and not in contact with the accumulated toner particles 101.

When forming an image, the intensity of the assist light beam 92 is increased or the intensity of the confinement light beam 93 is reduced to enable the toner particles 101 to travel to the paper sheet 150. Either the paper sheet 150 or the light beam 85 is moved for scanning to form an image on the paper sheet 150. In this embodiment, it is preferable to move the paper sheet 150 for scanning. When the light beams are moved for scanning, the angles of incidence of the assist light beam 92 and the confinement light beam 23 on the lens 91 may be changed. Alternatively, the lens 91 may be moved for scanning.

Figure 12A:
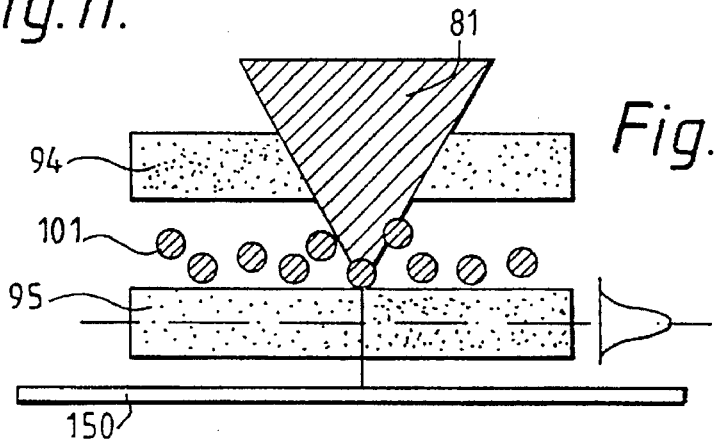
FIGS. 12(*a*), 12(*b*) and 12(*c*) are diagrammatic views of a portion of an image forming apparatus according to a further embodiment of the present invention using parallel confinement light beams.
Figure 12B:
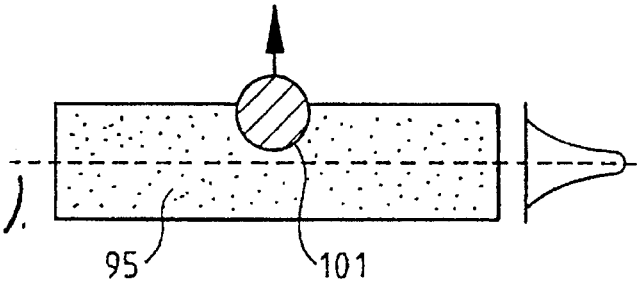
Figure 12C:
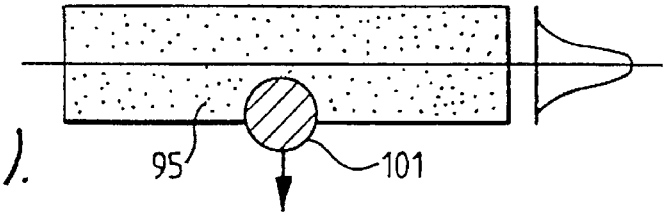

FIGS. 12(*a*), 12(*b*) and 12(*c*) illustrate a further embodiment of an image forming apparatus according to the present invention. This embodiment confines toner particles within a flat light beam. Since toner particles absorb light, a force acts on the toner particles so as to urge the toner particles from a region in which the intensity of the light beam is high toward a region in which the intensity of the light beam is low as shown in FIG. 12(*b*).

Therefore, when the intensity distributions of confinement light beams 94 and 95 are adjusted so that the intensity of each of the confinement light beams 94 and 95 in the middle of the thickness thereof is a maximum, toner particles 101 are confined within the confinement light beams 94 and 95 as shown in FIG. 12(*a*) so as to form a sheet-like toner layer. The intensity of the confinement light beam 95 is determined so that a force produced by the confinement light beam 95 and acting on the toner particles 101 is higher at least than the gravitational force acting on the toner particles 101.

A paper sheet 150 is placed substantially in parallel to the sheet-like toner layer, a concentrated laser beam 81 is projected substantially perpendicularly to the toner layer to make the toner particles 101 penetrate the confinement light beam 95.

As shown in FIG. 12(*c*), when the toner particles 101 are moved by the laser beam 81 to positions beyond the region of the confinement light beam 95 where the intensity of the confinement light beam 95 is a maximum, the confinement light beam 95 applies a force to the toner particles 101 to move the toner particles 101 further toward the paper sheet 150. Accordingly, the distance by which the toner particles 101 are moved by the laser beam 81 may be short and hence the laser beam 81 can be moved at a high scanning speed for scanning. The confinement light beams 94 and 95 may be two-dimensional light beams parallel to the paper sheet 150, and a thin light beam may be moved in parallel to the paper sheet 150 for scanning.

Since the toner particles are not restrained by adhesion in the image forming apparatuses of FIGS. 11 and 12(*a*), an electrostatic field need not be applied to the toner particles, so that the image forming apparatuses are simplified. Furthermore, no problem arises in the distribution of the characteristics of the toner.

Figure 13:
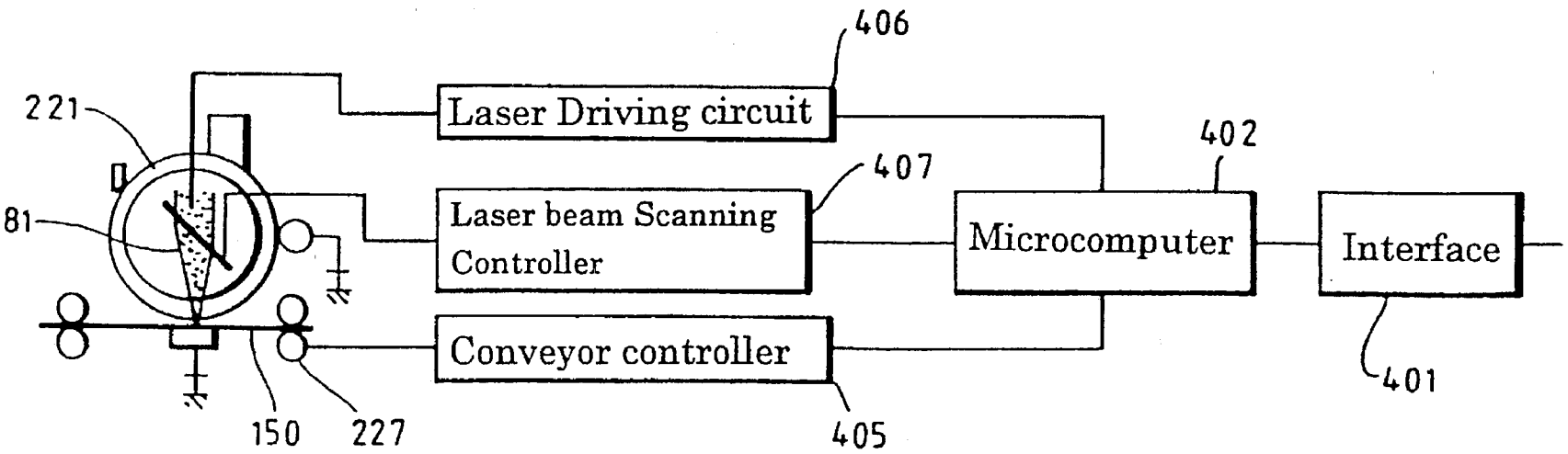
FIG. 13 is a schematic block diagram of a printer incorporating an image forming apparatus according to FIG. 2.

FIG. 13 shows a printer according to the present invention incorporating the image forming apparatus shown in FIG. 2. Image signals are given through an interface 401 to the printer. A microcomputer 402 controls a laser driving circuit 406 according to the image signals to control the intensity of the output light beam 81 of the laser light source. Conveying rollers 227 move an image recording medium 150 at a fixed speed. The travelling speed of the image recording medium 150 is controlled so as to match with the scanning speed of the laser beam 81 which is moved for scanning in the direction of the axis of the transparent drum 221 through a conveyor controller 405 by the microcomputer 402. A laser beam scanning controller 407 monitors and controls the scanning speed of the laser beam.

The image forming apparatus in accordance with the present invention is applicable to, for example, image recording units of copying machines and facsimile terminal equipment, as well as to a printer. The image forming apparatus of the present invention enables printers, copying machines, facsimile terminal equipment and the like to be formed in a small construction. When applied to a copying machine, the image forming apparatus may be provided with an image reading device, such as a contact type CCD, and the image forming apparatus may operate according to the output signals of the image reading device. When applied to a facsimile terminal equipment, the image forming apparatus may be provided with an image reading device and an external communication system.

Figure 14:
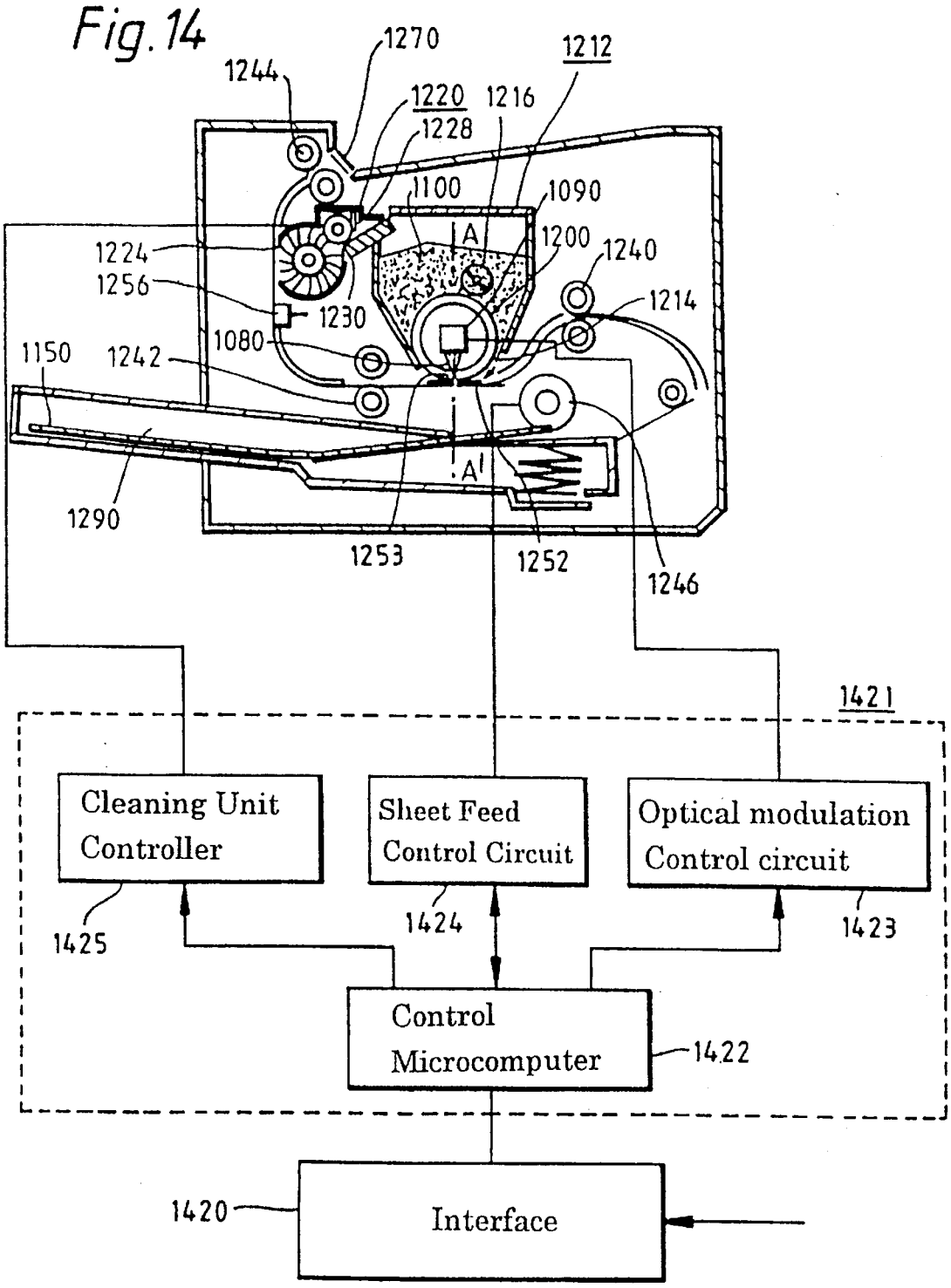
FIG. 14 illustrates an image forming apparatus according to a further embodiment of the present invention.

FIG. 14 shows a further embodiment of an image forming apparatus according to the present invention. A feed roller 1246 feeds a recording medium 1150, such as a paper sheet or a plastic film, delivered from a sheet cassette 1290. Conveyor rollers 1240 convey the recording medium 1150 to a position under a toner supply unit 1212. A toner 1100 is applied to the circumference of a transparent drum 1200 included in the toner supply unit 1212 and is conveyed to a position opposite the recording medium 1150.

An optical system 1090 is disposed at a position opposite the recording medium 1150 within the transparent drum 1200. The optical system 1090 projects a light beam 1080 controlled according to image information on the toner 1100. The toner 1100 irradiated with the light beam 1080 is separated from the transparent drum 1200 and is caused to move to the recording medium 1150 by the energy of the light beam 1080. Upon the separation of the toner 1100 from the transparent drum by the light beam 1080, the toner 1100 is melted and fixed to the recording medium 1150 by the energy of the light beam 1080.

Then, the recording medium 1150 is conveyed by conveyor rollers 1242 to a charger 1256, the charger 1256 recharges the toner 1100 on the recording medium 1150, and the conveyor rollers 1242 conveys the recording medium 1150 further to a cleaning unit 1220. The cleaning unit 1220 removes any unnecessary toner from the recording medium 1150. Then, the recording medium 1150 is delivered through an outlet 1270 by conveyor rollers 1244.

Since adhesion of the toner 1100 to the circumference of the transparent drum 1200 is comparatively low, a portion of the toner 1100 not irradiated with the light beam is liable to fly away from the transparent drum 1200 and to deposit on the recording medium 1150. However, since the portion of the toner 1100 irradiated with the light beam is melted and fixed to the recording medium 1150 while the portion of the toner 1100 not irradiated with the light beam and deposited on the recording medium 1150 is not fixed, the portion of the toner 1100 not irradiated with the light beam can be easily removed from the recording medium 1150 by the cleaning unit 1220.

A control circuit 1421 receives image signals through an interface 1420, and produces image data. The control circuit 1421 controls the optical system, the sheet feed unit, the cleaning unit and the toner supply unit. A control microcomputer 1422 receives image signals from the interface 1420, forms image data and sends the image data to an optical modulation control circuit 1423.

The control microcomputer 1422 also sends a sheet feed timing signal to a sheet feed control circuit 1424, receives a position signal indicating the position of a recording medium and gives a light source actuation timing signal to the optical modulation control circuit 1423. The optical modulation control circuit 1423 controls the intensity of the light emitted by the optical system 1090 to form an image according to the image data.

The control microcomputer 1422 receives a position signal indicating the position of the recording medium from a position sensor, not shown, and gives a start timing signal for timing the start of the cleaning unit to a cleaning unit controller 1425. A sheet feed cassette 1290 feeds a recording medium 1150, and the conveyor rollers 1230, 1232 and 1234 conveys and delivers the recording medium 1150.

Since a printer incorporating the image forming apparatus of the present invention can be relatively small, it is suitable for a desk-top printer. Image data of an image to be printed on one recording medium need not be stored in a memory, and only a required portion need be printed.

Figure 15:
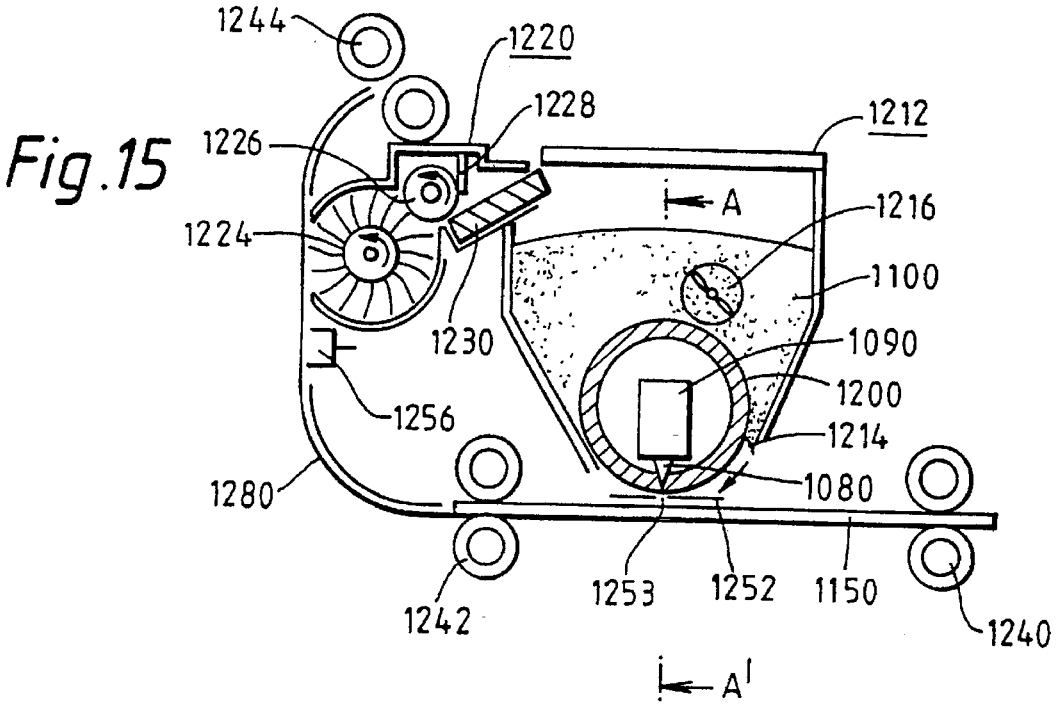
FIG. 15 is an enlarged view of the drum and associated equipment of the apparatus of FIG. 14.

The toner supply unit and the cleaning unit will now be described, with reference to FIG. 15. First the toner supply unit 1212 will be described. The toner 1100 is charged by the frictional action of a blade 1214 or a stirring roller 1216 and is attracted to the transparent drum 1200 by a force produced by an image charge induced in the transparent drum 1200. The blade 1214 levels off a toner layer formed over the circumference of the transparent drum 1200 to produce a substantially constant layer thickness. As mentioned above, the optical system 1090 is disposed within the transparent drum 1200. The light beam 1080 emitted by the optical system 1090 is concentrated on the circumference of the transparent drum 1200 to irradiate the toner 1100. The toner 1100 is separated from the transparent drum 1200 and is caused to move to the recording medium 1150 by a light pressure and a photophoretic force produced by the light beam 1080.

Since these forces produced by the light beam 1080 and acting on the toner 1100 are comparatively low, a voltage is applied across the transparent drum 1200 and an electrode 1252 to reduce the adhesion of the toner 1100 to the transparent drum 1200. The voltage may be either an ac voltage or a dc voltage. If an ac voltage is applied across the transparent drum 1200 and the electrode 1252, the toner 1100 moves to and fro between the transparent drum 1200 and the electrode 1252 according to an ac signal.

Particles of the toner 1100 exposed to the light beam 1080 travel through a slit 1253 formed in the electrode to the recording medium 1150. The light beam 1080 has an intensity high enough to melt the toner 1100. The particles of the toner 1100 separated from the transparent drum 1200 are melted and fixed to the recording medium 1150.

The image forming apparatus of the present invention may not always remove the toner 1100 adhering to the transparent drum 1200. In case a portion of the toner 1100 exposed to the light beam 1080 does not separate from the transparent drum 1200 and is melted and solidifies on the transparent drum 1200, the solidified toner may be removed from the transparent drum 1200 with a scraping means. The toner 1100 may be dispersed in a volatile solvent to produce a disperse system and the disperse system may be applied to the transparent drum 1100. When such a disperse system is used, it is desirable that the volatile solvent evaporates completely before reaching an irradiating position.

The recording medium 1150 is conveyed along a guide 1280 to the cleaning unit 1220 by the conveyor rollers 1240 and 1242. Then, an unfixed portion of the toner 1100 adhering to the recording medium 1150 is removed from the recording medium 1150 and recovered by the cleaning unit 1220.

Figure 17:
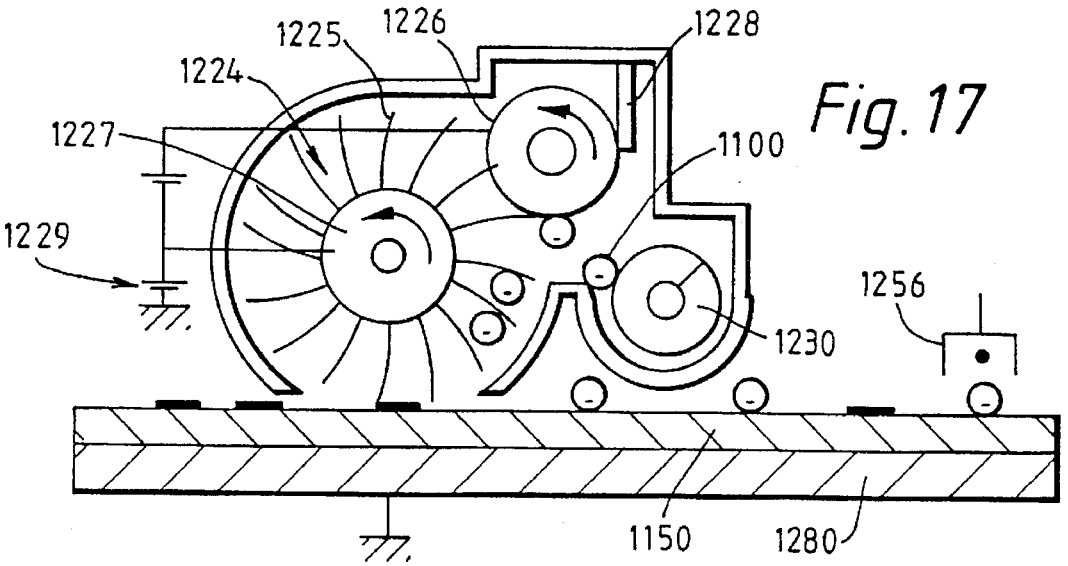
FIG. 17 is a schematic sectional view of the cleaning unit of the apparatus of FIG. 14

The cleaning unit 1220 will be described in detail with reference to FIG. 17. The cleaning unit 1220 employed in this embodiment is a bias cleaner. The cleaning unit 1220 is provided with a conductive brush 1224 formed by attaching conductive bristles 1224 to a conductive member such as a metal roller 1227. A voltage is applied to the conductive brush 1224 so as to attract the unfixed, charged particles of the toner 1100 to separate them from the recording medium 1150. Since the toner 1100 is charged negatively in this embodiment, a positive voltage relative to a housing provided with the guide 1280 is applied to the conductive brush 1224 by a circuit 1229.

The unfixed toner adhering to the conductive brush 1224 is transferred from the conductive brush 1224 to a recovering roller 1226 to which a positive voltage relative to the potential of the conductive brush 1226 is applied. The unfixed toner adhering to the recovering roller 1226 is scraped off the recovering roller 1226 with a blade 1228. Then, the unfixed toner scraped off the recovering roller 1226 is returned to the toner supply unit 1212 by a toner feed screw 1230 to use the same again. The unfixed toner is recharged by a charger 1256 disposed before the cleaning unit 1220 to recover all the unfixed toner by the cleaning unit 1220. If the unfixed toner has a sufficiently large charge, the charger 1256 may be omitted.

The cleaning unit may be other than a bias cleaner; for example, the cleaning unit may be a fur brush system that recovers the unfixed toner by mechanically removing the unfixed toner from the recording medium with a brush roller and recovering the unfixed toner from the brush roller by a blower. Alternatively, the cleaning unit may be a magnetic brush system that recovers the unfixed toner electrostatically by a magnetic carrier, or a suction system that sucks the unfixed toner by a suction device.

The paper sheet may be coated with a silicon oil or the like before transferring the toner to the paper sheet to facilitate the recovery of the unfixed toner from the recording medium. When a liquid is used to facilitate the recovery of the unfixed toner from the recording medium, it is desirable that the liquid is volatile.

Preferably, the image forming apparatus is provided with a foreign matter removing means for removing foreign matter from the recovered toner because the toner recovered from the recording medium 1150 by the cleaning device 1220 contains such foreign matter as paper powder.

Although it is desirable that the conveyor rollers 1240, 1242 and 1244 do not touch the printed surface, the conveyor rollers 1240, 1242 and 1244 may touch the printed surface because, even if these rollers touch the unfixed toner forming an image, the unfixed toner is recovered by the cleaning unit 1220 after the recording medium 1150 has passed these rollers.

Figure 16:
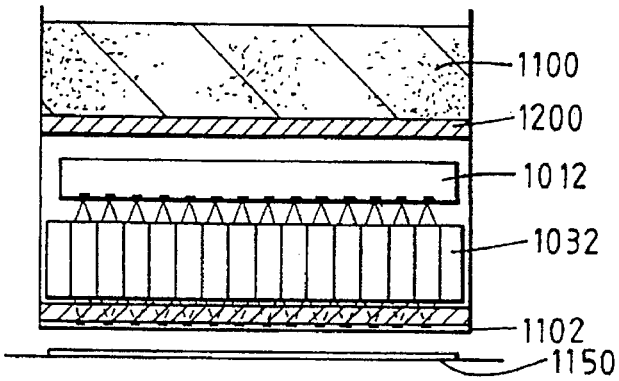
FIG. 16 is a view of an optical system according to a further embodiment of the present invention.

The optical system of this embodiment will be described with reference to FIG. 16 which is a sectional view taken on line A–A' in FIGS. 14 and 15. A LED array 12, i.e., a light source, and a rod lens array 1032 are disposed within the transparent drum 1200. The LED array 1012 comprises a plurality of light emitting diodes (LEDs) arranged at intervals corresponding to a required resolution in which an image is to be formed, and the rod lenses of the rod lens array 1032 are arranged so as to correspond to the LEDs, respectively.

Light beams emitted by the LEDs are concentrated on a toner layer 1102 formed on the transparent drum 1200 by the rod lens array 1032. As mentioned above, toner particles irradiated with the light beams are separated from the transparent drum 1200 and are caused to move to the recording medium 1150 by the force produced by the energy of the light beams.

A semiconductor laser array may be employed instead of the LED array 1012.

Figure 18:
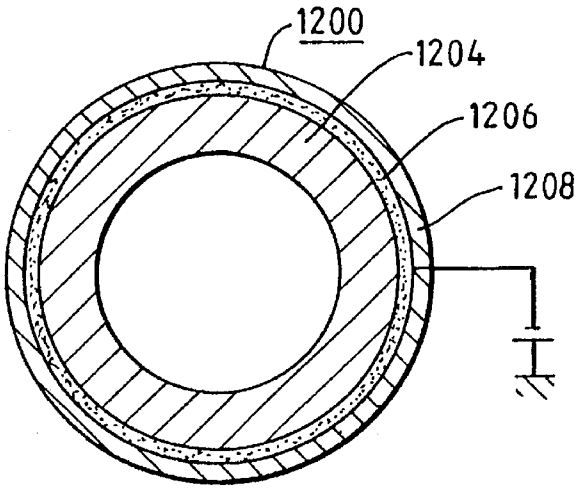
FIG. 18 is a sectional view of a transparent drum of the apparatus of FIG. 14.

FIG. 18 shows the transparent drum 1200 of this embodiment of the image forming apparatus. The transparent drum 1200 comprises a transparent drum body 1204, a transparent electrode 1206 of an ITO film formed over the circumference of the transparent drum body 1204, and a protective film 1208 of a transparent dielectric, such as SiN, $SiO_2$ or $Al_2O_3$, coating the transparent electrode 1206. A voltage is applied to the transparent electrode 1206.

Since this embodiment does not use a photoconductive member, the life of the drum can be extended by hardening the circumference of the drum.

A flexible transparent belt capable of extending along a conveying passage may be employed instead of the transparent drum. The optical system may be an optical scanning system.

Figure 19:
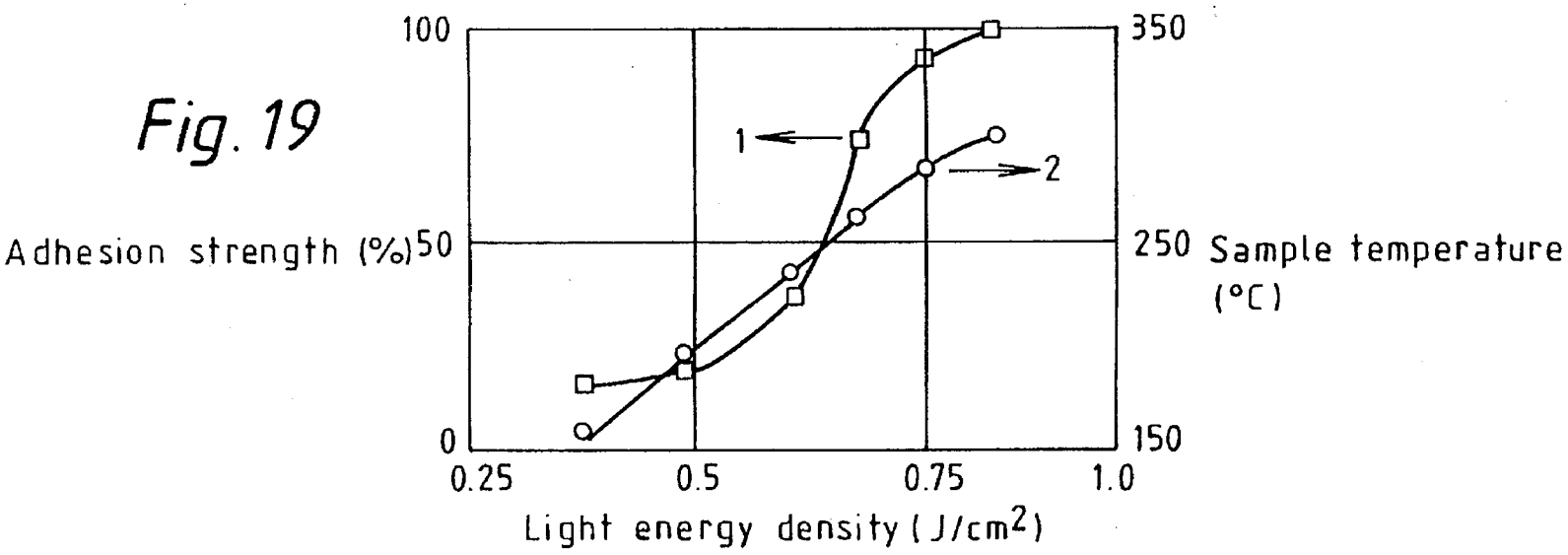
FIG. 19 is a graph showing the relation between light energy density and fixing strength for the apparatus of FIG. 14.

FIG. 19 includes two graphs, graph 1 showing the variation of the adhesion strength of a toner with light energy density on the toner, determined by experiment, and graph 2 showing surface temperature against light energy density. In FIG. 19, adhesion strength is the ratio of the amount of the toner remaining on a paper sheet to the amount of the toner fixed to the paper sheet when an adhesive tape is applied to the fixed toner and then peeled off. The mean particle size of the toner used in the experiment was 10 μm.

A preferable adhesion strength is 50% or above and hence, from FIG. 19, a desirable light energy density is 0.65 $J/cm^2$ or above. It was confirmed that the maximum temperature of the surface of the toner was 250° C. or above when light energy density was 0.65 $J/cm^2$ or above.

The experiment showed that the toner was fixed to the paper sheet even when light energy density was 0.5 $J/cm^2$ and the fixed toner could not be removed from the paper sheet by a force on a rubbing level. Accordingly, only the unfixed toner can be removed by the cleaning unit when the toner is irradiated with light in a light energy density of 0.5 $J/cm^2$ or above (the maximum surface temperature of the toner is 170° C. or above).

The amount of energy necessary for melting one toner particle is proportional to the volume of the toner particle. The amount of light energy per unit weight of a toner particle of 1.1 $g/cm^3$ in density is $2.1\times10^6$ J/kg or above, and desirably, $2.3\times10^6$ J/kg or above.

Since the present embodiment of the invention does not need a photoconductive member or a fixing unit, the image forming apparatus is simple and small in construction as compared with the conventional electrophotographic image forming apparatus. Not provided with any fixing unit, the image forming apparatus of the present invention does not need to heat a heat roller having a comparatively large heat capacity, and therefore consumes less power than the conventional electrophotographic image forming apparatus. It can also be started immediately for quick-start operation after being connected to a power source because the image forming apparatus does not need any warm-up time for heating the heat roller.

Not having any photoconductive member, the image forming apparatus of the present invention has less expendable parts which need to be replaced occasionally than the conventional electrophotographic image forming apparatus. Additionally, not having any photoconductive member containing such an injurious substance as selenium, the image forming apparatus of the present invention when scrapped exerts less detrimental influence on the environment than the conventional electrophotographic image forming apparatus. Furthermore, using a toner as image forming medium, the image forming apparatus of the present invention requires less frequent replacement of the image forming medium and needs less running cost than an image forming apparatus employing a thermosensible ink ribbon.

The optical system of the image forming apparatus in this embodiment provided with a two-dimensional spatial modulator has a simple configuration and can be formed in a compact construction.

Figure 20:
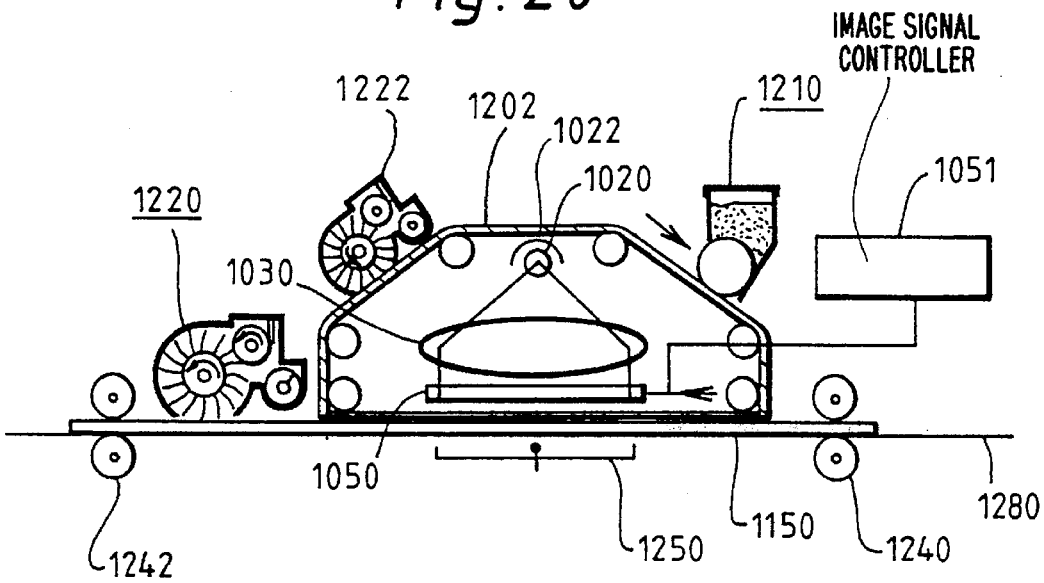
FIG. 20 is a schematic sectional view of an image forming apparatus according to a further embodiment of the present invention.

FIG. 20 shows a further embodiment of an image forming apparatus according to the present invention. A toner supply unit 1210 applies a toner over the entire surface of a transparent belt 1202. The transparent belt 1202, coated with the toner, turns so that a portion thereof coated with the toner moves under an optical system. A spherical reflecting mirror 1022 reflects a flash light beam emitted by a flash lamp 1020 efficiently toward a lens 1030, and the lens 1030 collimates the flash light beam.

The collimated flash light beam falls on a spatial modulator 1050 comprising a two-dimensional array of elements. The spatial modulator 1050 is controlled according to image signals from an image signal controller 1051 so as to pass only portions of the flash light beam corresponding to portions of the toner coating the transparent belt 1202 to be transferred to a recording medium 1150.

The toner adhering to the transparent belt 1202 is charged, and the adhesion of the toner to the transparent belt 1202 is reduced by an electrostatic force acting between a charging electrode 1250 disposed opposite to the spatial modulator 1050, and the transparent belt 1202; that is, the toner is held to the transparent belt 1202 by only a weak force. When portions of the toner are irradiated with portions of the light beam penetrating the spatial modulator 1050, the irradiated portions of the toner are separated from the transparent belt 1202 by forces produced by the light beam (including a light pressure and photophoretic force).

The portions of the toner separated from the transparent belt 1202 are melted by the flash light beam and are fixed to the recording medium 1150. Since the toner in an area of the transparent belt 1202 facing the charging electrode 1250 is restricted to the transparent belt 1202 by a weak force, portions of the toner not irradiated with the flash light beam fall and deposit on the recording medium 1150. However, this unnecessary toner is removed by a recording medium cleaning unit 1220.

The recording medium 1150 is conveyed along a guide 1280 by conveyor rollers 1240 and 1242. The toner remaining on the transparent belt 1202 after the portions of the toner have been irradiated with the flash light beam is removed by a belt cleaning unit 222. The toner recovered by the belt cleaning unit 222 may be used again.

The spatial modulator 1050 may be disposed between the flash lamp 1020 and the lens 1030. When disposed between the flash lamp 1020 and the lens 1030, the spatial modulator 1050 may be of a small size. If the flash light beam is converged by the lens 1030 and the toner layer is irradiated with the converged flash light beam, the resolution is enhanced beyond the resolution of the spatial modulator 1050. Desirably, the resolution of the spatial modulator 1050 is 300 dpi or above.

The recording medium 1150 is advanced a distance corresponding to the length of the spatial modulator 1050 after the toner layer has been irradiated with the flash light beam, and then the next image forming cycle is executed. If the density of the image is insufficient, the same portions of the toner layer may be irradiated twice with the flash light beam before advancing the recording medium.

An ac voltage may be applied to the charging electrode 1250. Desirably, the surface irregularity of the transparent belt is in the range of 0.01 to 1 μm to reduce the adhesion of the toner to the transparent belt. Ultrasonic vibrations may be applied to the transparent belt instead of applying the electric field created by the charging electrode 1250 to the transparent belt, to reduce the adhesion of the toner to the transparent belt. If the toner is melted on and adheres to the transparent belt, each of portions of a long transparent belt may be used only once and the used portions of the transparent belt may be taken up.

Figure 21:
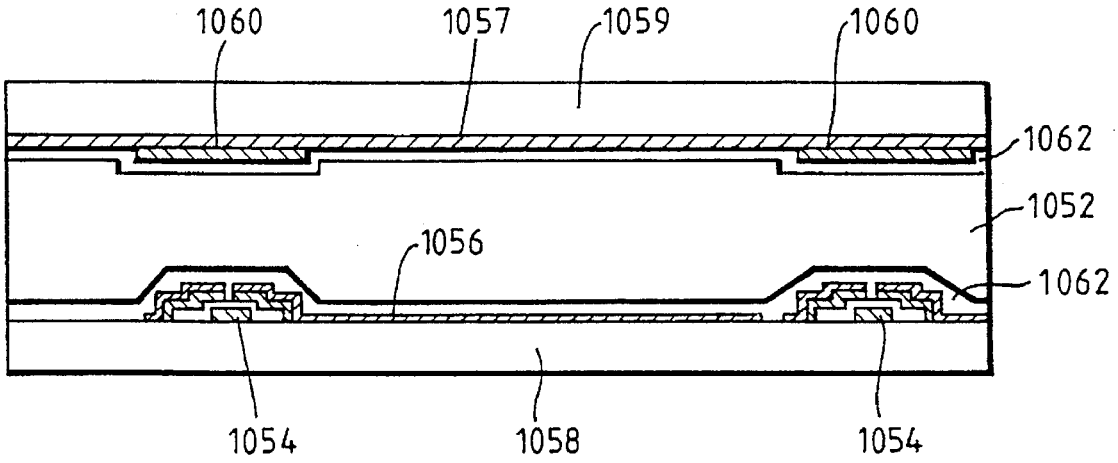
FIG. 21 is a schematic sectional view of a spatial modulator for use in the apparatus of FIG. 20.

FIG. 21 shows the spatial modulator of a polymer dispersion type employed in the above embodiment. Thin-film transistors (TFTs) 1054 are formed on a glass substrate 58 by using amorphous silicon. The TFTs 1054 control the application of a voltage to transparent electrodes 1056. Transparent electrodes 1057 and a mask 1060 for shielding the TFTs 1054 from light are formed on a counter glass substrate 1059. The transparent electrodes 1056 and 1057 are coated with protective films 1062. A polymer dispersion type liquid crystal material 1052 is sealed in a space between the protective films 1062.

Since the respective refractive indices with respect to a light transmitting direction of the polymer and the dispersion medium are different from each other when no voltage is applied across the transparent electrodes 1056 and 1057, light falling on the polymer dispersion type liquid crystal material 1052 is scattered and is not transmitted. When an electric field is applied to the polymer dispersion type liquid crystal material 1052, the respective refractive indices of the polymer and the dispersion medium coincide with each other and the polymer dispersion type liquid crystal material 1052 transmits light.

Since a spatial modulator employing polymer dispersion type liquid crystal material scarcely absorbs light, the spatial modulator is not damaged even if the same is irradiated with light of a high intensity.

The size of the spatial modulator 1050 may be the same as that of the recording medium 1150, or the spatial modulator 1050 may have the same width as that of the recording medium and a length, i.e., size along the recording medium conveying direction, shorter than the length of the recording medium 1150, such as a length equivalent to the size of every line of an image along the recording medium conveying direction.

The spatial modulator 1050 may have minute mirrors formed by etching a Si substrate and which are capable of being set in a desired angular position by an electrostatic force.

Figure 22:
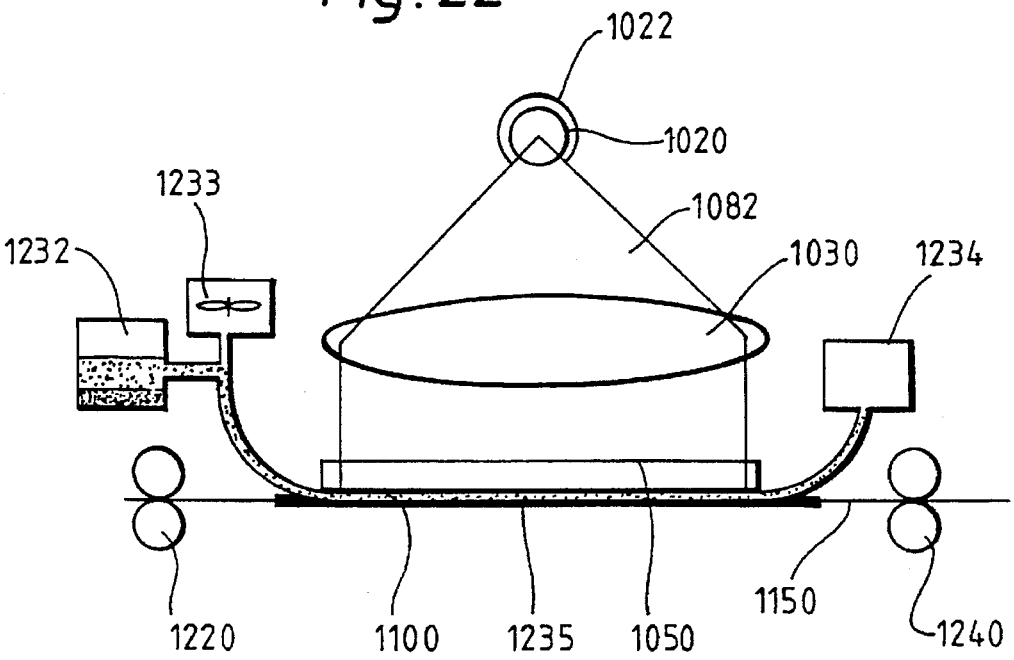
FIG. 22 is a schematic view of an image forming apparatus according to a further embodiment of the present invention.

FIG. 22 shows a further embodiment of an image forming apparatus according to the present invention, employing a flash lamp 1020 as light source. A cylindrical lens 1030 collimates a flash light beam 1082 emitted by the flash lamp 1020. The collimated flash light beam 1082 falls on a spatial modulator 1050 having a liquid crystal display panel two-dimensionally displaying a desired image.

Portions of the light beam penetrate the spatial modulator 1050 and irradiate toner particles 1100 afloat in a space between the spatial modulator 1050 and a recording medium 1150. The irradiated toner particles are caused to move toward the recording medium 1150 by a force produced by the light beam, and absorb light energy to melt and form an image on the recording medium.

The recording medium 1150 is conveyed under the spatial modulator 1050 toward a cleaning unit 1220 by conveyor rollers 1240 after the image has been formed thereon by melting the toner particles and fixing the molten toner particles in toner dots 1104. The cleaning unit 1220 removes toner particles not irradiated with the light beam which have fallen on to the recording medium 1150. A toner cloud generating unit 1232 generates a cloud of toner particles. Toner particles afloat in the cloud are fed into a space under the spatial modulator 1050 by a fan 1233. Surplus toner particles are collected in a toner tank 1234. The toner may be circulated for repeated use.

Figure 23:
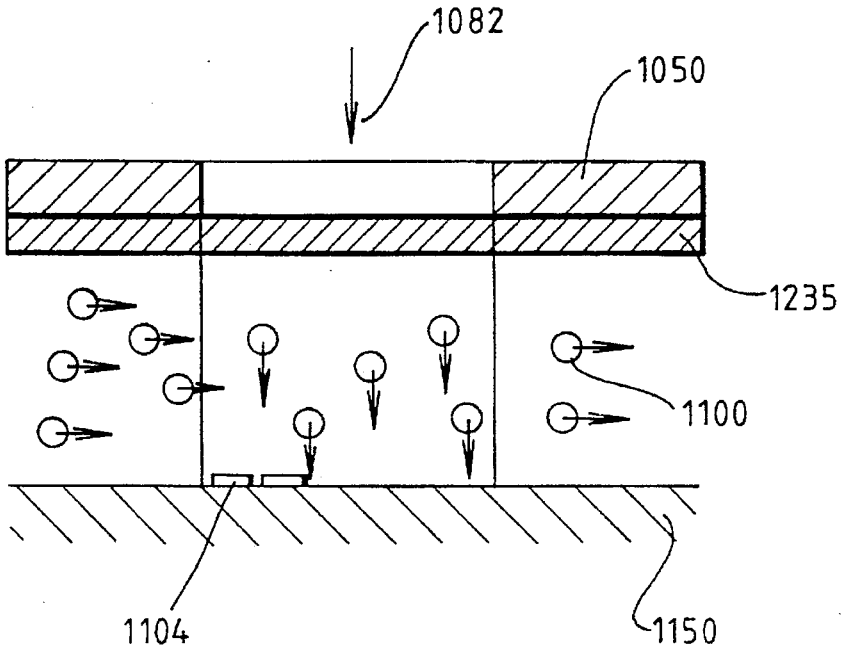
FIG. 23 is a schematic view explaining the motion of toner particles in the apparatus of FIG. 22.

FIG. 23 is an enlarged view of the space between the spatial modulator 1031 and the recording medium 1150. Toner particles drift between a transparent partition plate 1235 and the recording medium 1150. Toner particles 1100 irradiated with the flash light beam 1082 are caused to move toward the recording medium by a force produced by light and absorb light energy to melt. The toner particles 1100 having kinetic energy are melted and adheres to the recording medium 1150 in toner dots 1104 to form an image.

The flash lamp 1010 is 400 J in output light energy and about 1 msec in flash duration. A spherical reflecting mirror 1022 is disposed behind the flash lamp 1020 to reflect efficiently light travelling in a direction opposite to a direction toward the lens 1030. An area of 20 cm×5 cm is exposed to light in each exposure cycle. The recording medium of sheet size A4 is shifted 5 cm after every exposure cycle to form an image on the recording medium.

Since the viscosity Of air acts on toner particles in a direction reverse to the direction of movement of the toner caused by the flash light beam, the toner particles are stopped after moving about 30 μm. When the movement of the toner particles is insufficient, the flash lamp 1020 may be flashed several times to enable the toner particles to reach the recording medium before the recording medium is shifted.

The image forming apparatus may be provided with a pulsed laser instead of the flash lamp. A lamp or a laser that emits light continuously may be employed provided that the light output of the lamp or the laser is sufficiently large. When a laser is employed, a light beam emitted by the laser may be expanded so as to irradiate the entire area of the spatial modulator, or the light beam may be moved for scanning.

If the light beam is moved for scanning, the intensity of the light beam need not be modulated and the image forming apparatus need not be provided with a complex light modulator, because the image forming apparatus is provided with the spatial modulator, which simplifies the image forming apparatus.

It is desirable that the light emitted by the light source has a power density large enough to apply a light pressure higher than the gravity acting on the image forming medium, to reduce the influence of the gravity on the motion of the image forming medium. It is also desirable that the time t for which one particle of the image forming medium is exposed to light is nearly equal to or longer than a time constant $\tau$ required for the viscous drag of the ambience to balance with the force urging the particle to move, to make the particle move in uniform motion.

The time constant is expressed by:

$$\tau = m/6\pi\mu r$$

where r is the radius of the particle of the image forming medium, m is the mass of the particle of the image forming medium and $\mu$ is the coefficient of viscosity of the ambient fluid.

A desirable value of the time t meets an inequality:

$$t \geqq \tau/2$$

Particles of the image forming medium drift and move in a space between a transparent partition plate, such as a glass plate, and the image recording medium. The thickness of the space between the transparent partition plate and the image recording medium must be at least twice the mean particle size of the image forming medium to enable the particles of the image forming medium to move smoothly between the transparent partition plate and the image recording medium.

It is desirable that the interval between the partition plate and the image recording medium is nearly equal to a distance by which particles of the image forming medium are moved by light pressure. Therefore, the enlargement of the space between the transparent partition plate and the image recording medium is inexpedient; a desirable interval between the transparent partition plate and the image recording medium is 1100 times or less the mean particle size of the image forming medium.

In this embodiment, the image forming medium strikes the recording medium as it is conveyed. Since the image forming medium is conveyed through an unenclosed conveying passage, the conveying passage may be spacious and hence the toner can be readily supplied.

If the adhesion of the toner dots is insufficient, the toner dots may be fixed by a fixing unit disposed after the recording sheet cleaning unit.

Since a two-dimensional area is exposed to the exposure light at each time by using the spatial modulator, the duration of exposure to the exposure light of each particle of the image forming medium can be increased without increasing the time necessary for forming an image. Therefore, the travel distance of the image forming medium can be increased. A spatial modulator having a one-dimensional arrangement of elements may be employed. If the transparent partition plate is liable to become heavily soiled, the image forming apparatus may be provided with a transparent partition plate cleaning mechanism.

Figure 24:
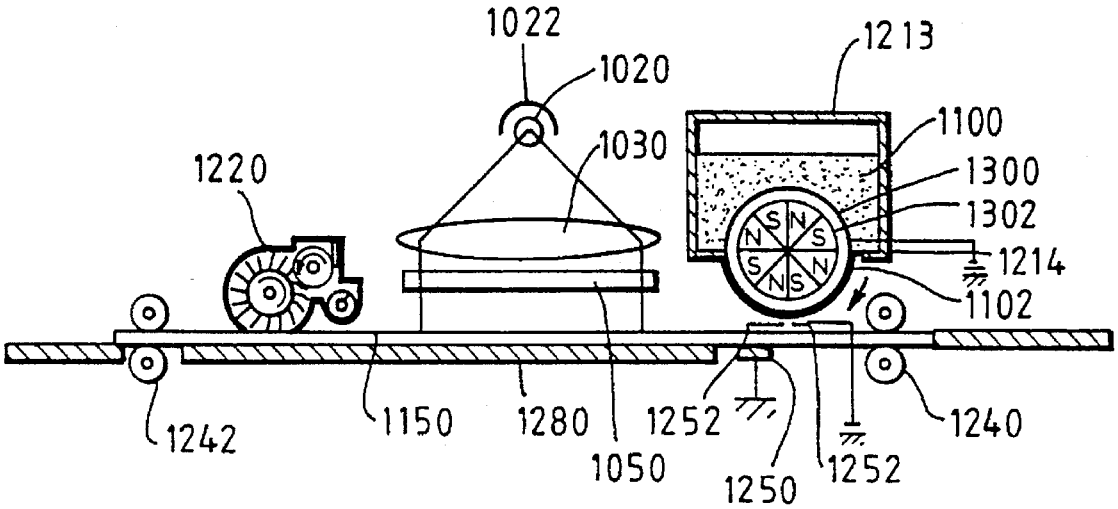
FIG. 24 is a schematic sectional view of an image forming apparatus according to a further embodiment of the present invention.

FIG. 24 shows a further embodiment of an image forming apparatus according to the present invention. In this embodiment, a toner is applied beforehand to a recording sheet, portions of the toner spread over the recording sheet and that toner corresponding to an image are melted and fixed to the recording sheet. Unfixed portions of the toner are removed by a cleaning unit.

A toner supply unit 1213 applies a toner to a recording medium 1150. A spherical reflecting mirror 1022 reflects a light beam emitted by a flash lamp 1020 toward a lens 1030. The lens 1030 collimates the light beam, and then the collimated light beam falls on a two-dimensional spatial modulator 1050. The spatial modulator 1050 passes only portions of the light beam corresponding to the image.

Toner particles irradiated with the portions of the light beam melts and fixedly adhere to the recording medium 1150. Then, unfixed toner particles are removed from the recording medium 1150 and collected by a cleaning unit 1220. The recording medium is conveyed along a guide 1280 by conveying rollers 1240 and 1242.

The toner supply unit 1213 will now be described in detail. A magnetic roller 1302 is disposed within a conductive sleeve 1300 formed of a nonmagnetic material such as aluminum. The toner 1100 employed in this embodiment is a magnetic toner. The toner 1100 is attracted to the conductive sleeve 1300 by the magnetic force of the magnet roller 1302 and the toner is charged by the frictional action of a blade 1214. The blade 1214 regulates the amount of the toner 1100 on the conductive sleeve 1300, in order to form a toner layer 1102 of a fixed thickness. The toner 1200 is moved to a position opposite an electrode 1252 as the conductive sleeve 1300 rotates.

When voltage is not applied to the electrode 1252, particles of the charged toner 1100 are caused to fly away from the conductive sleeve 1300 and adhere to a recording medium 1150 by the action of a voltage applied across the conductive sleeve 1300 and the electrode 1250. When a voltage of the same polarity as that of the conductive sleeve 1300 is applied to the electrode 1252, particles of the toner are restrained from flying away from the conductive sleeve 1300.

The electrode 1252 is divided into electrode sections with respect to a direction perpendicular to the direction of travel of the recording medium. The toner can be optionally selectively applied to desired regions of the recording medium by controlling the voltages to be applied to the electrode sections. For example, the toner can be applied only to regions corresponding to an image by controlling the voltages according to image data. As mentioned above, since the toner is applied only to necessary regions of the recording medium, the necessary amount of the toner is small and the amount of the toner to be removed from the recording medium is small, so that unfixed toner can be readily recovered.

The regions to which the toner is to be applied can be selectively determined by controlling the voltages of the electrode sections of the electrode 252 arranged along a direction perpendicular to the travelling direction of the recording medium 1150. There may be, for example, between 3 and 3000 sections.

It is possible to use a sectional electrode having a plurality of electrode sections as the electrode 1250 and to omit the electrode 1252. If the electrode 1252 is omitted, the toner layer 1102 may be brought into contact with the recording medium 1150.

If the toner is applied to the entire surface of the recording medium, the electrodes 1250 and 1252 need not be divided into electrode sections. If the toner is nonmagnetic, it is necessary only to use the toner in combination with a magnetic carrier.

The image forming apparatus in this embodiment is simple and small in construction.

Figure 25:
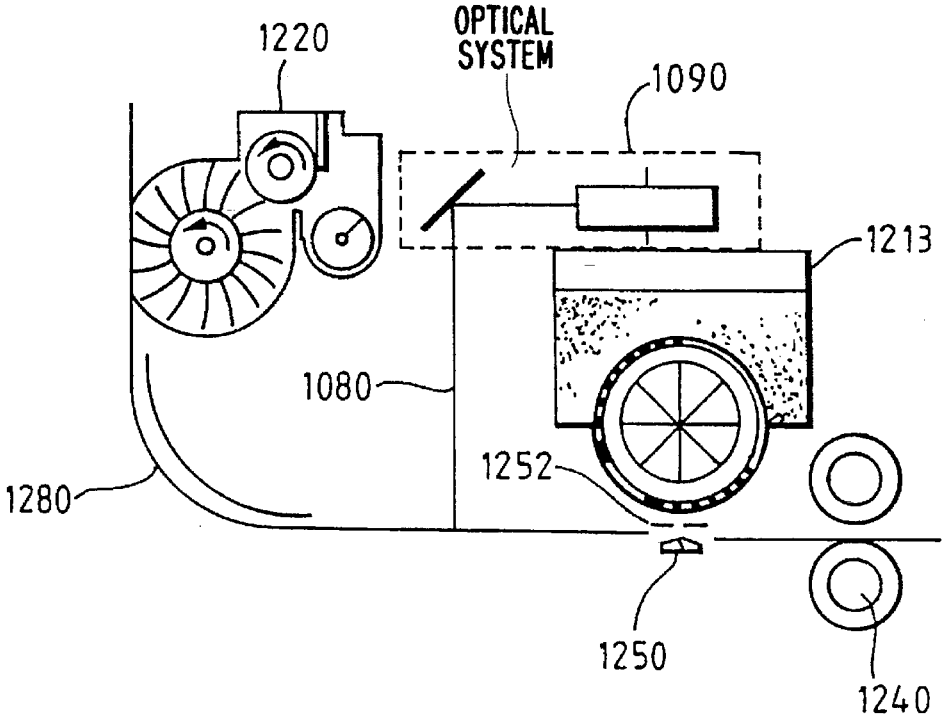
FIG. 25 is a schematic sectional view of an image forming apparatus according to a further embodiment of the present invention.

FIG. 25 shows a further embodiment of an image forming apparatus according to the present invention. This embodiment employs the same toner supply unit as that shown in FIG. 24. A toner supply unit 1213 applies a toner only to necessary portions of a recording medium 1150. A concentrated light beam 1080 emitted by an optical system 1090 provided with an optical scanning unit is moved for scanning, and the intensity of the light beam is modulated to melt particles of the toner adhering to the recording medium so that the molten particles solidify and are fixed to the recording medium. The recording medium is conveyed along a guide 1280 to a cleaning unit 1220 by conveyor rollers 1240. Unfixed toner is recovered by the cleaning unit 1220. The cleaning unit is disposed on a level higher than the level on which the toner supply unit is disposed to facilitate transferring the recovered toner from the cleaning unit to the toner supply unit and to use the internal space of the image forming apparatus efficiently.

Figure 26:
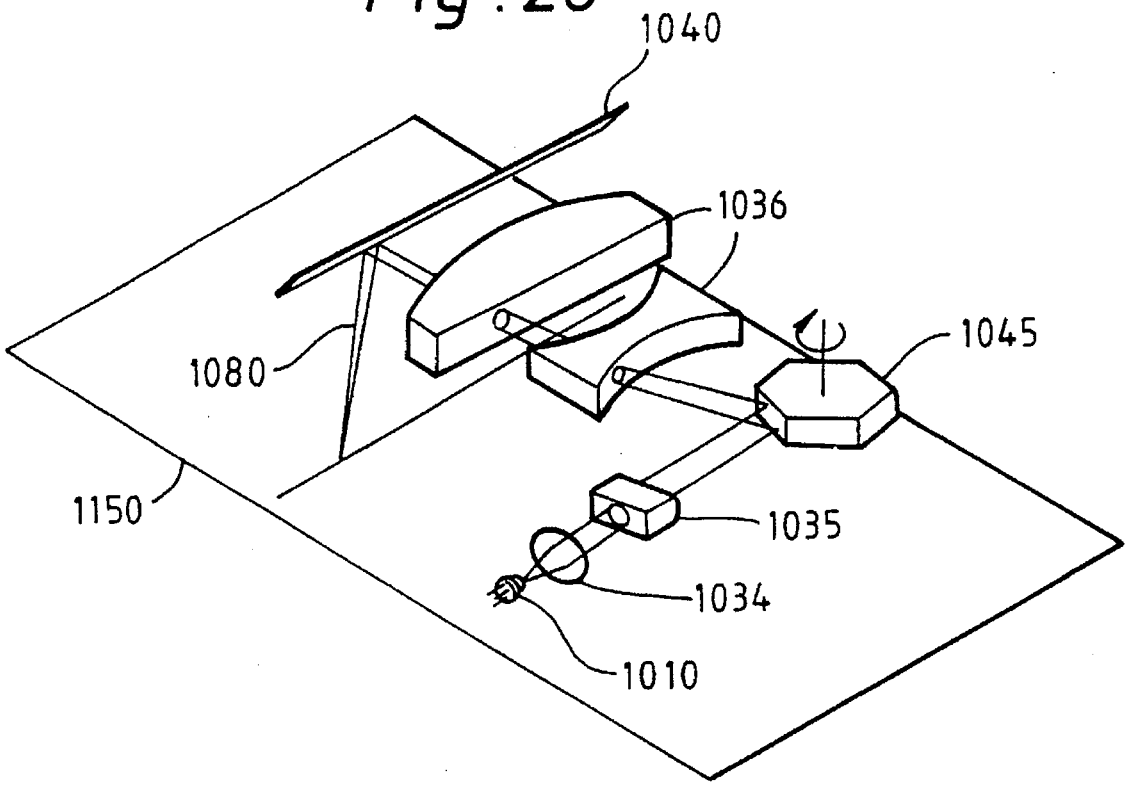
FIG. 26 is a perspective view of an optical system for use in the apparatus of FIG. 14.

FIG. 26 shows the optical system of the above embodiment. A collimator lens 1034 collimates a light beam emitted by a semiconductor laser 1010.

A cylindrical lens 1035 concentrates the collimated light beam onto a polygonal rotating mirror 1045 with respect to the feed direction. The light beam reflected by the polygonal rotating mirror 1045 is converged by a doublet spatial lens so as to be focused on a recording medium 1150 after being reflected by a reflecting mirror 1040. The spot of the light beam moves on the recording medium 1150 as the polygonal rotating mirror 1045 rotates.

Desirably, the power of the light beam focused on the recording medium 1150 is 100 mW or above. When the power of the light beam is 100 mW or above, images can be printed on at least one recording medium of paper size A4 per minute in a resolution of 300 dpi.

The optical unit may be provided with an acoustooptic device or a galvanomirror instead of the polygonal rotating mirror.

Since the light beam is focused and moved for scanning, the resolution of this embodiment is dependent on the spot size of the light beam on the recording medium and the image forming apparatus is capable of forming an image in a high resolution.

It is desirable to focus the of a light beam in a spot of a diameter in the range of 2 to 70 μm. When the light beam is moved for scanning, the desirable spot diameter is in the range of 30 to 70 μm. The resolution can be increased by reducing the diameter of the spot. It is also desirable to focus the light beam in a spot having a small spot diameter to heat toner particles intensively. A preferable range of spot diameter to enhance light energy density is 2 to 10 μm.

Figure 27:
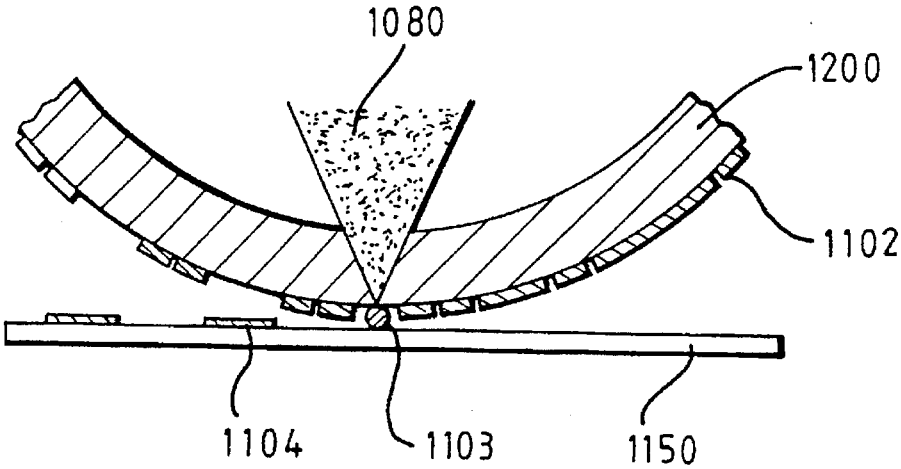
FIG. 27 is a fragmentary sectional view of a portion of an image forming apparatus according to a further embodiment of the present invention.

FIG. 27 shows a further embodiment of an image forming apparatus according to the present invention. A light source, which may be the same as that shown in FIG. 16, is disposed within a transparent drum 1200. This embodiment uses a flat light beam to irradiate a toner. A recording medium 150 is set close to the transparent drum 1200 coated with a toner layer 1102 so as not to be in contact with the toner layer 1102. When toner particles are melted with a light beam 1080, the surface tension makes the molten toner particles round (e.g. particle 1103) and, consequently, the rounded, molten toner particles touch the recording medium 1150. Then, the molten toner particles are transferred from the transparent drum 1200 to the recording medium 1150 by the capillarity of capillaries formed between the fibers of the recording medium 1150. The particles then adhere to the recording medium 1150 in toner dots 1104 forming an image. Thus, the formation of an image and fixation of toner particles are achieved simultaneously.

Figure 28:
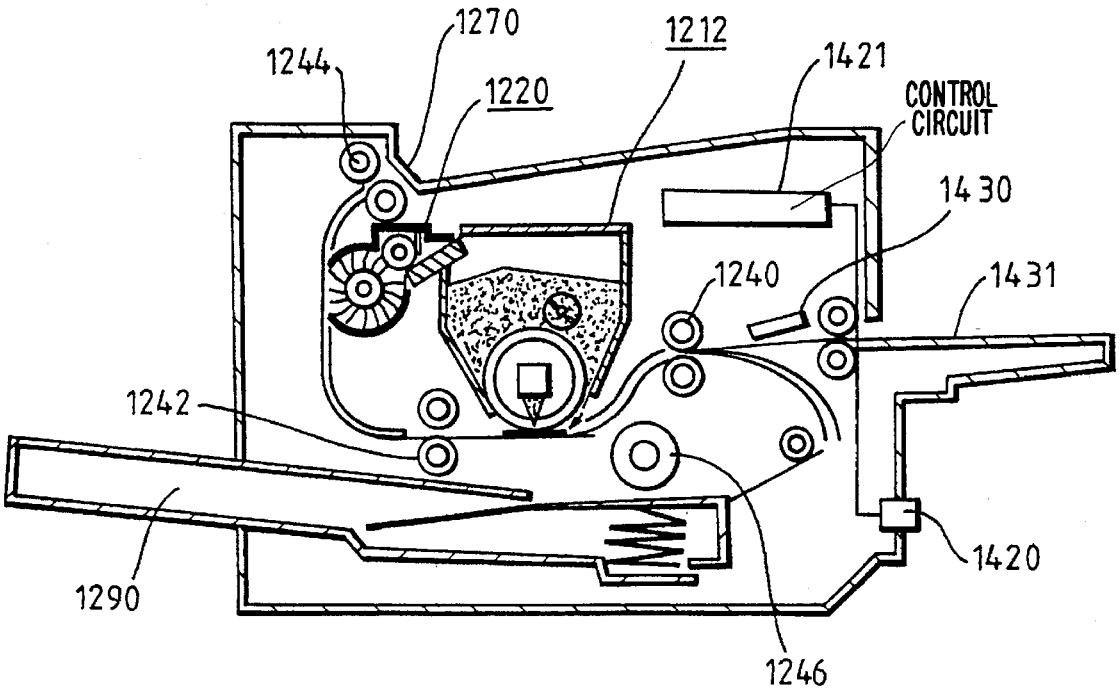
FIG. 28 is a schematic sectional view of a facsimile terminal equipment incorporating an image forming apparatus of FIG. 14.

FIG. 28 shows a facsimile terminal equipment incorporating the image forming apparatus of the present invention shown in FIG. 14. The image forming apparatus included in the facsimile terminal equipment is provided with at least a document read unit, an image signal input/output unit and a communication control unit. In this embodiment, the document read unit is a contact sensor 1430. The interface 1420 is connected to a telephone circuit. The control circuit 1421 controls communication operations. A document is inserted through a document inlet 1431 into the facsimile terminal equipment.

The facsimile terminal equipment incorporating the image forming apparatus of the present invention need not store image data for one recording medium in a memory and is capable of successively printing out incoming data. Therefore, the storage capacity of the memory of this facsimile terminal equipment may be smaller than that of a facsimile terminal equipment incorporating a conventional electrophotographic image forming apparatus.

Figure 29:
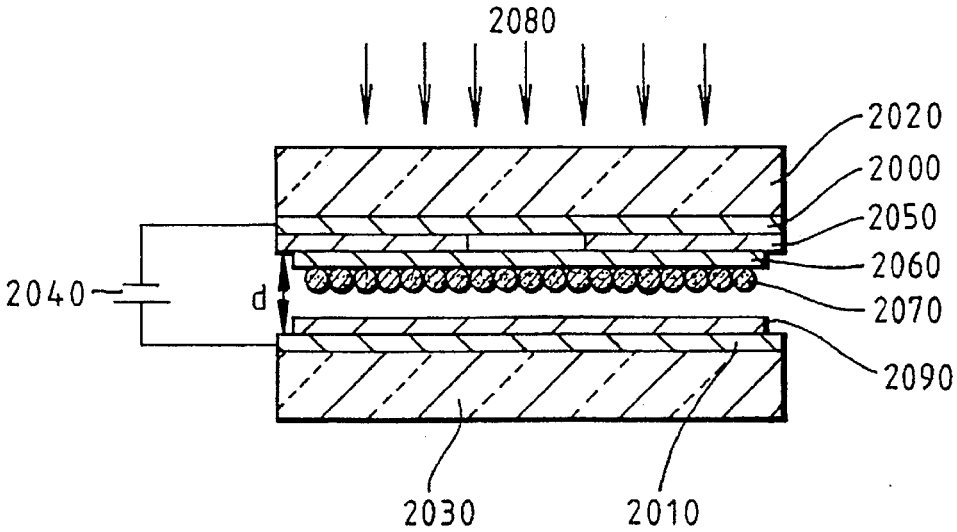
FIG. 29 is a schematic view of yet another embodiment of the present invention.

FIG. 29 illustrates a further embodiment of the present invention. A pair of transparent electrodes 2000, 2010 are each fixed to a respective glass substrate 2020, 2030, and face each other. An electric field is provided between the transparent electrodes by an electric circuit 2040.

On side of the uppermost electrode 2000 facing the lower electrode 2010 is placed a mask 2050 containing image information. On top of the mask is placed a transparent sheet 2060 on which is fixed a layer of toner 2070.

When light 2080 is flashed onto the upper surface of the upper glass substrate 2020, particles of the toner layer 2070 not covered by the mask 2050 will be irradiated by the light and moved out of the toner layer. These particles are then propelled towards a piece of paper 2090, which is located adjacent the lower electrode 2010, in order to form an image thereon. The image-forming particles of toner may be fixed to the paper by the action of the light. For such purposes, the light may be applied a second time to the image-forming toner particles.

While the invention has been illustrated by specific embodiments, it is not limited to those embodiments and extends to all modifications and improvements in accordance with the concept of the invention.

What is claimed is:

1. Apparatus for production of an image on a recording medium, said apparatus comprising:

a mass of non-magnetic toner, a toner carrier member for delivering at least a portion of said mass of non-magnetic toner to a position separated by a gap from said recording medium such that said portion does not normally contact said recording medium;

means for production of an energy beam, said energy beam being modulatable by image information and directable at selected particles of said mass of non-magnetic toner in order to impinge upon said selected particles to impart energy to said selected particles to force said selected particles into said gap, and an energy source, other than said means for production of an energy beam, for imparting additional energy to said selected particles to move said selected particles through said gap onto said recording medium.

2. Apparatus according to claim 1, wherein said means for production of an energy beam includes light means for production of one or more light beams.

3. Apparatus according to claim 1, including means for imparting an electrostatic charge to said selected particles, and wherein said energy source includes means for production of an electric field to move said selected particles through said gap onto said recording medium.

4. Apparatus according to claim 3, including a hollow member, said hollow member having a surface against which at least part of said mass of toner, including said selected particles, is retainable, wherein said means for production of an energy beam is located inside said hollow member.

5. Apparatus for production of an image on a recording medium, said apparatus comprising:

a mass of toner, means for production of an energy beam, said energy beam being modulatable by image information and directable at selected particles of said mass of toner in order to impart energy to said selected particles, an energy source, other than said means for production of an energy beam, for imparting additional energy to said selected particles to move said selected particles onto said recording medium, means for imparting an electrostatic charge to said selected particles, and wherein said energy source includes means for production of an electric field to move said selected particles onto said recording medium, and a hollow member, said hollow member having a surface against which at least part of said mass of toner, including said selected particles, is retainable, wherein said means for production of an energy beam is located inside said hollow member, wherein said hollow member includes a first electrode which is part of said means for producing an electric field.

6. Apparatus according to claim 5, including a second electrode which is part of said means for producing an electric field, said second electrode being positioned so as to be on the opposite side of said recording medium to said first electrode when said selected particles are being moved onto said recording medium.

7. Apparatus according to claim 5, including a second electrode which is part of said means for producing an electric field, said second electrode being positioned so as to be between said recording medium and said first electrode when said selected particles are being moved onto said recording medium, said second electrode having an aperture through which said selected particles are movable.

8. Apparatus for production of an image on a recording medium, said apparatus comprising:

mass of toner, means for production of an energy beam, said energy beam being modulatable by image information and directable at selected particles of said mass of toner in order to impinge upon said selected particles to impart energy to said selected particles, and an energy source, other than said means for production of an energy beam, for imparting additional energy to said selected particles to move said selected particles onto said recording medium;

wherein said means for production of an energy beam includes a light means for producing an array of fight beams.

9. Apparatus for production of an image on a recording medium, said apparatus comprising:

a mass of toner, means for production of an energy beam, said energy beam being modulatable by image information and directable at selected particles of said mass of toner in order to impart energy to said selected particles, and an energy source, other than said means for production of an energy beam, for imparting additional energy to said selected particles to move said selected particles onto said recording medium, wherein said means for production of an energy beam includes light means for production of one or more light beams, wherein a plurality of light beams are producible by said light means, each one of said plurality of light beams carrying data relating to production of a differently colored image on said recording medium.

10. Apparatus for production of an image on a recording medium, said apparatus comprising:

a mass of toner, means for production of an energy beam, said energy beam being modulatable by image information and directable at selected particles of said mass of toner in order to impart energy to said selected particles, and an energy source, other than said means for production of an energy beam, for imparting additional energy to said selected particles to move said selected particles onto said recording medium, further including means for fixing said selected particles to said recording medium, and means for removing unfixed toner from said recording medium.

11. A method of producing an image on a recording medium, including the steps of:

(i) a toner carrier member for delivering at least a portion of a mass of non-magnetic toner to a position separated by a gap from said recording medium such that said portion does not normally contact said recording medium;

(ii) selecting particles of said portion of said mass of non-magnetic toner by imparting energy thereto by impinging an energy beam modulated by image information upon said particles to force said selected particles into said gap, followed by (iii) moving said selected particles through said gap onto said recording medium at least partially using additional energy from an energy source other than said energy beam.

12. A method according to claim 11, wherein said selected particles carry an electrostatic charge and said additional energy is imparted to said selected particles by an electric field.

13. A method according to claim 11, wherein said selected particles are separated from the mass of toner by said step (ii).

14. A method according to claim 11, wherein said selected particles are fixed onto the recording medium by direct irradiation by said energy beam.

15. A method of producing an image on a recording medium, including the steps of:

(i) selecting particles of a mass of toner by imparting energy thereto by irradiation by an energy beam modulated by image information, followed by (ii) moving said selected particles onto said recording medium at least partially using additional energy from an energy source other than said energy beam, wherein said selected particles are fixed onto the recording medium by direct irradiation by said energy beam, and subsequently removing from the recording medium any unfixed particles of said mass of toner carried thereon.

16. A method according to claim 11, wherein said energy beam includes one or more light beams.

17. A method of producing an image on a recording medium, including the steps of:

(i) fixing selected particles of a mass of toner onto said recording medium by direct irradiation by an energy beam modulated by image information, followed by (ii) removing from said recording medium any unfixed particles of said mass of toner carried thereon.

18. A method according to claim 17 wherein said mass of toner is applied to the recording medium prior to step (i).

19. Apparatus for producing an image on a recording medium, said apparatus comprising:

a mass of toner;

means for production of an energy beam, said beam being modulatable by image information and directable at selected particles of said mass of toner in order to fix said selected particles to said recording medium; and means for removing from said recording medium any unfixed particles carried thereon.

20. Apparatus according to claim 19, including means for applying said mass of toner to the recording medium.

21. Apparatus according to claim 20, wherein said means for applying include an electrostatic carrier to which at least a part of said mass of toner is attachable prior to application to said recording medium.

22. A method of producing an image on a recording medium, including the steps of:

(i) confining a mass of toner in a space, at least a part of a boundary of said space being formed by a first energy beam, and (ii) selectively removing particles of said mass of toner from said space by impinging upon said particles a second energy beam to impart energy to said particles, and depositing said particles onto said recording medium.

23. A method of producing an image on a recording medium, including the steps of:

(i) confining a mass of toner in a space, at least a part of a boundary of said space being formed by a first energy beam, and (ii) selectively removing particles of said mass of toner from said space and depositing said particles onto said recording medium, wherein said first energy beam is substantially planar and a further part of the boundary of the space is defined by a second substantially planar energy beam which is substantially parallel to said first energy beam.

24. A method of producing an image on a recording medium, including the steps of:

(i) confining a mass of toner in a space, at least a part of a boundary of said space being formed by a first energy beam, and (ii) selectively removing particles of said mass of toner from said space and depositing said particles onto said recording medium, wherein in step (ii) said particles are removed by direct irradiation by a modulated energy beam, said modulated energy beam being modulated by image information.

25. A method of producing an image on a recording medium, including the steps of:

(i) selecting particles of a mass of toner by imparting energy thereto by irradiation by a first energy beam modulated by image information, followed by (ii) moving said selected particles onto said recording medium, and (iii) fixing said selected particles onto said recording medium by direct irradiation by a second energy beam modulated by image information.

26. A method according to claim 25, wherein both said first energy beam and said second energy beam are produced by one energy beam production means.

27. A method of producing an image on a recording medium, including the steps of:

(i) electrostatically carrying a mass of non-magnetic toner to a predetermined location separated by a gap from said recording medium such that said mass of non-magnetic toner does not normally contact said recording medium, (ii) at said location, selecting particles of said mass of non-magnetic toner by imparting energy thereto by impinging irradiation upon said selected particles by an energy beam modulated by image information so as to force said selected particles into said gap, followed by (iii) moving said selected particles through said gap onto said recording medium.

28. Apparatus for producing an image on a recording medium, said apparatus comprising:

a substantially transparent drum;

a mass of toner carried on said drum; and means for production of an energy beam, said energy beam being modulatable by image information and directable to impinge upon selected particles of said mass of toner in order to impart energy to said selected particles;

said means for production of an energy beam being located inside said substantially transparent drum.

29. Apparatus for producing an image on a recording medium, said apparatus comprising:

a substantially transparent drum;

a mass of toner carried on said drum;

means for production of an energy beam, said energy beam being modulatable by image information and directable at selected particles of said mass of toner in order to impart energy to said selected particles;

said means for production of an energy beam being located inside said substantially transparent drum, and means for production of an electric field to move said selected particles onto said recording medium, said drum including an electrode which is part of said means for production of an electric field.

30. Apparatus for production of an image on a recording medium, said apparatus comprising:

a mass of toner, a toner carrier member for delivering at least a portion of said mass of toner to a position separated by a gap from said recording medium such that said portion does not normally contact said recording medium;

means for production of an energy beam, said energy beam being modulatable by image information and directable at selected particles of said mass of toner in order to impinge upon said selected particles to impart energy to said selected particles to force said selected particles into said gap, and an energy source, other than said means for production of an energy beam, for imparting additional energy to said selected particles to move said selected particles through said gap onto said recording medium.

31. A method of producing an image on a recording medium, including the steps of:

(i) a toner carrier member for delivering at least a portion of a mass of toner to a position separated by a gap from said recording medium such that said potion does not normally contact said recording medium;

(ii) selecting particles of said portion of said mass of toner by imparting energy thereto by impinging an energy beam modulated by image information upon said particles to force said selected particles into said gap, followed by (iii) moving said selected particles through said gap onto said recording medium at least partially using additional energy from an energy source other than said energy beam.

32. A method of producing an image on a recording medium, including the steps of:

(i) electrostatically carrying a mass of toner to a predetermined location separated by a gap from said recording medium such that said mass of toner does not normally contact said record medium;

(ii) at said location, selecting particles of said mass of toner by imparting energy thereto by impinging irradiation upon said selected particles by an energy beam modulated by image information so as to force said selected particles into said gap, followed by (iii) moving said selected particles through said gap onto said recording medium.

* * * * *